US007869747B2

(12) United States Patent
Ichikawa

(10) Patent No.: US 7,869,747 B2
(45) Date of Patent: Jan. 11, 2011

(54) DEVELOPER CONTAINER AND METHOD FOR FILLING THE SAME

(75) Inventor: Hideo Ichikawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 158 days.

(21) Appl. No.: 12/106,356

(22) Filed: Apr. 21, 2008

(65) Prior Publication Data

US 2009/0136266 A1 May 28, 2009

(30) Foreign Application Priority Data

Nov. 27, 2007 (JP) ..... 2007-306096
Dec. 6, 2007 (JP) ..... 2007-316215

(51) Int. Cl.
*G03G 15/08* (2006.01)

(52) U.S. Cl. ..... 399/263; 399/256; 399/262

(58) Field of Classification Search ..... 399/263, 399/120, 253, 262, 256; 222/DIG. 1
See application file for complete search history.

(56) References Cited

U.S. PATENT DOCUMENTS

| | | | | |
|---|---|---|---|---|
| 4,887,132 | A * | 12/1989 | Joseph et al. | 399/256 |
| 5,758,238 | A * | 5/1998 | Mordenga et al. | 399/256 |
| 5,918,095 | A * | 6/1999 | Huang | 399/263 |
| 2007/0048023 | A1* | 3/2007 | Thompson et al. | 399/254 |
| 2007/0264053 | A1* | 11/2007 | Iwata et al. | 399/254 |

FOREIGN PATENT DOCUMENTS

| | | | |
|---|---|---|---|
| JP | 6-180531 | A | 6/1994 |
| JP | 10-247009 | A | 9/1998 |
| JP | 2000-305344 | A | 11/2000 |
| JP | 2002-268344 | A | 9/2002 |
| JP | 2003-5499 | A | 1/2003 |
| JP | 2004-264539 | A | 9/2004 |
| JP | 2006-053446 | A | 2/2006 |

OTHER PUBLICATIONS

Office Action dated Feb. 9, 2010, in Japanese appln. No. 2007-306096.

Office Action dated Jan. 29, 2010, in Australian appln. No. 2008202180.

* cited by examiner

*Primary Examiner*—David M Gray
*Assistant Examiner*—Rodney Bonnette
(74) *Attorney, Agent, or Firm*—Sughrue Mion, PLLC

(57) ABSTRACT

A developer container includes: a container chamber that has a container space for containing a developer; and an conveyance member having a rotation shaft and a spiral member and which rotates inside the container space about the rotation shaft, the spiral member being spirally extended to hold a first angle to an axial direction of the rotation shaft, and the spiral member being provided with a plurality of low-angle portions, wherein at least one of the low-angle portions is provided in each unit segment which is equivalent to one turn of the spiral member about the rotation shaft, and an amount of a developer contained in the container space is enough to constantly bury any of the plurality of low-angle portions in the developer under a condition that the axial direction of the rotation shaft is held to be horizontal inside the container space.

7 Claims, 12 Drawing Sheets

FIG. 6
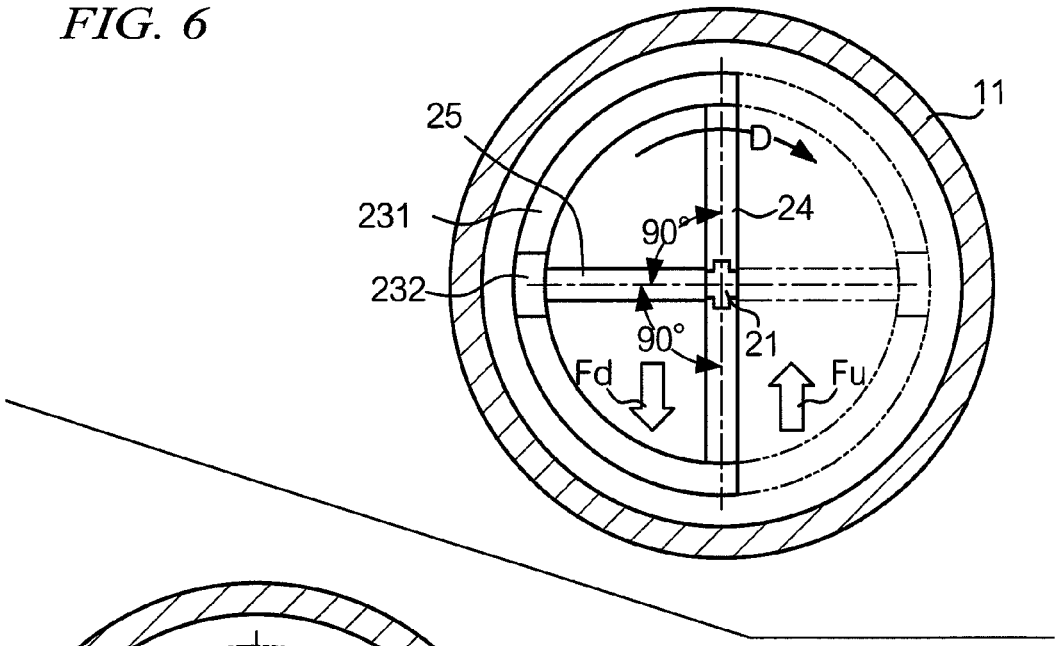
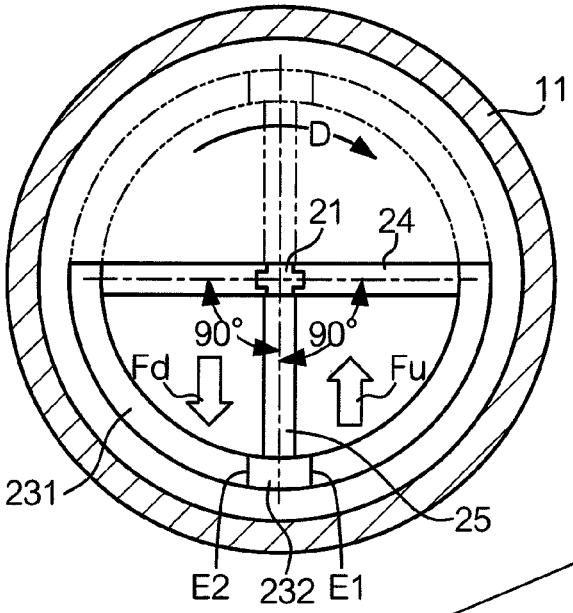
FIG. 7
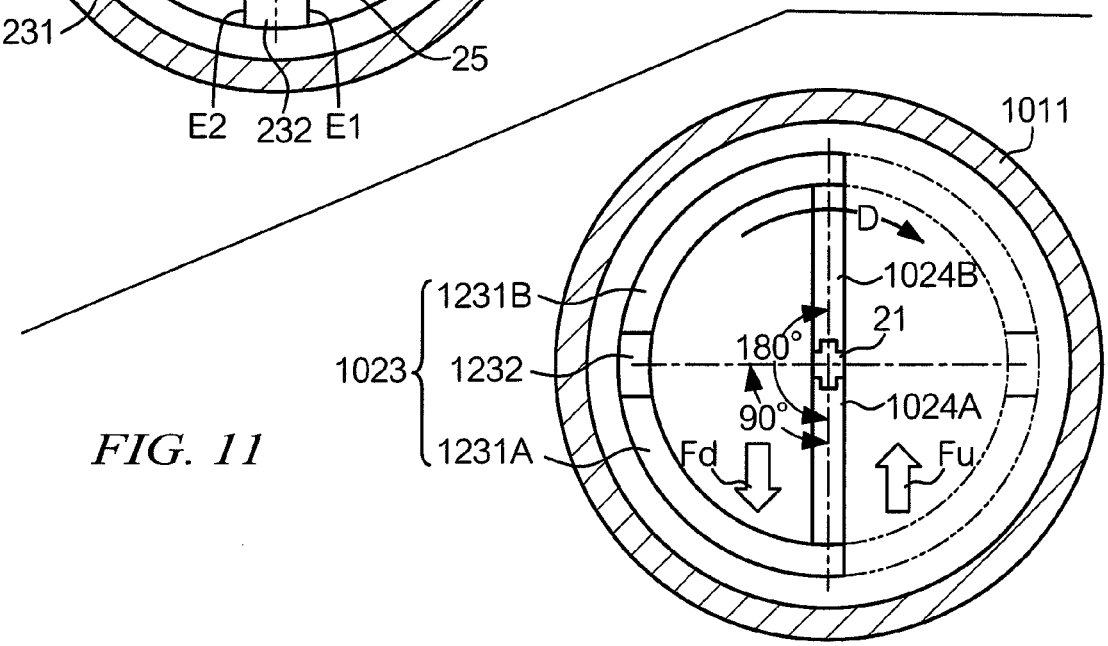
FIG. 11

DEVELOPER CONTAINER AND METHOD FOR FILLING THE SAME

CROSS-REFERENCE TO RELATED APPLICATIONS

This application claims priority under 35 USC 119 from Japanese patent applications No. 2007-306096 filed Nov. 27, 2007 and 2007-316215 filed Dec. 6, 2007.

BACKGROUND

1. Technical Field

The present invention relates to a developer container and a filling method for filling the developer container with a developer.

2. Related Art

There are in use image forming devices which develop images by use of developers. For use with such image forming devices, attachable/detachable developer containers are available for filling developer containers with developer. The developer containers are usually called toner cartridges, and each toner cartridge is constituted of a cylindrical container and an conveyance member included in the container. The conveyance member is manufactured, for example, by spiral winding of a wire to fit within an inner circumference of the cylindrical container. As the conveyance member is rotated in a constant direction, a developer contained in the cylindrical container is stirred and conveyed to an output port provided at an end of the cylindrical container. The developer is discharged from the output port and into the developing device.

SUMMARY

The invention provides a developer container suitable for loosening and feeding a developer and a filling method for filling the developer container with a developer.

According to one aspect of the invention, there is provided a developer container including: a container chamber that has a container space for containing a developer; and an conveyance member having a rotation shaft and a spiral member and which rotates inside the container space about the rotation shaft as a rotation center, the spiral member being spirally extended to hold a first angle to an axial direction of the rotation shaft, and the spiral member being provided with a plurality of low-angle portions each of which holds a smaller angle to the axial direction than the first angle, wherein at least one of the low-angle portions is provided in each unit segment which is equivalent to one turn of the spiral member about the rotation shaft, and an amount of a developer contained in the container space is enough to constantly bury any of the plurality of low-angle portions in the developer under a condition that the axial direction of the rotation shaft is held to be horizontal inside the container space.

BRIEF DESCRIPTION OF THE DRAWINGS

Embodiments of the invention will be described in detail based on the following figures, wherein:

FIG. 6 is a side view of a main part of a modification;

FIG. 7 shows an spiral member when low-angle portions are positioned at the bottom of a container chamber;

FIG. 11 is a cross-sectional view of a main part of the specified segment shown in FIG. 9, viewed from an upstream side in the feed direction;

DETAILED DESCRIPTION

Embodiments of the invention will now be described with reference to the drawings.

A. First Embodiment

A-1. Entire Structure of Toner Cartridge 10

Figure 1:
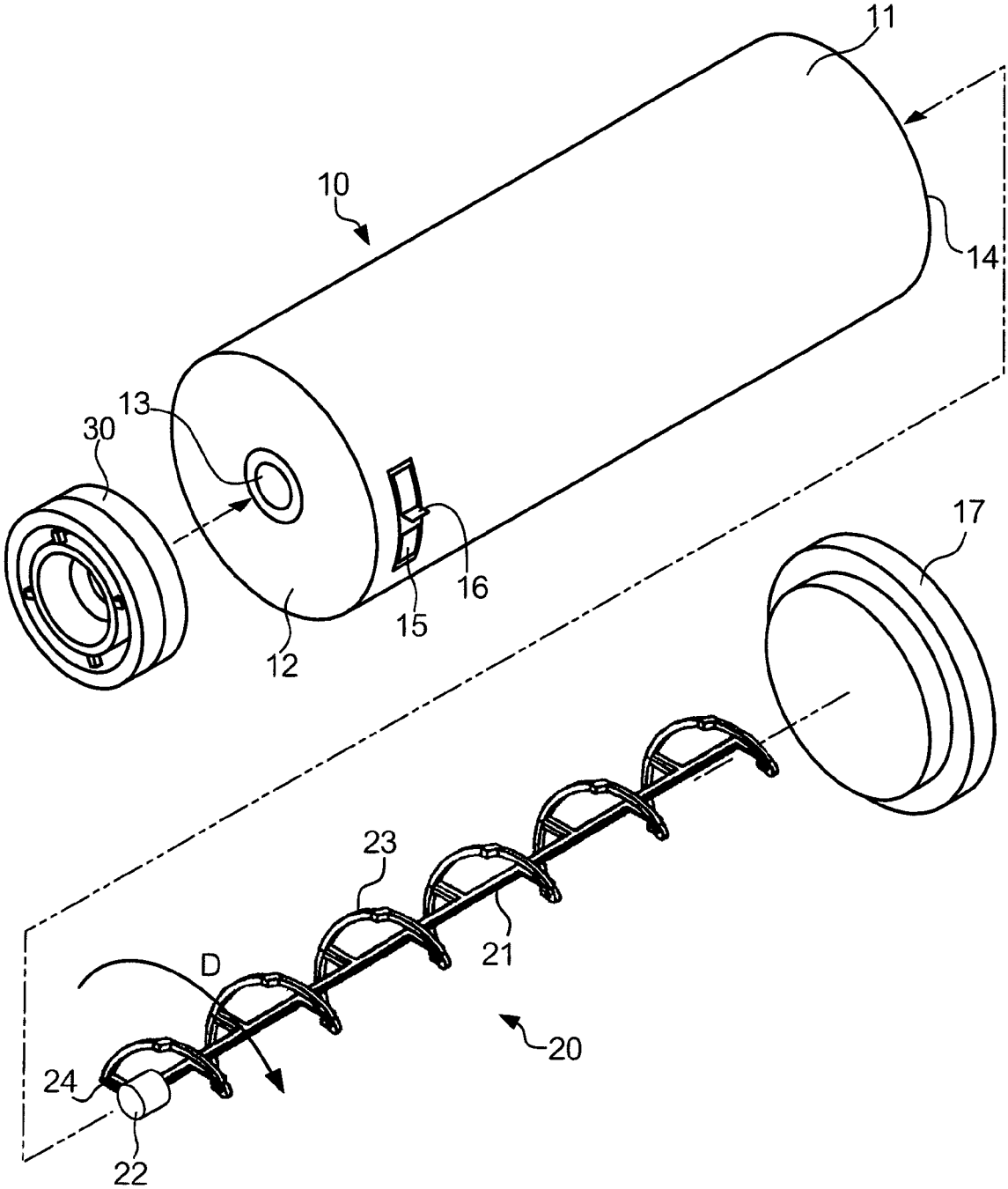
FIG. 1 is an exploded perspective view for explaining a structure of a toner cartridge.

FIG. 1 is an exploded perspective view showing a structure of a toner cartridge 10 as an example of a developer container.

The toner cartridge 10 includes a container 11, a cap 17, an conveyance member 20 as an example of an conveyance member, and a coupling 30. The toner cartridge 10 is configured to be attachable/detachable to/from an image forming device, not shown. The container 11 is a cylindrical member having a bottom, and is made of paper or plastics. A container space (hereinafter a container chamber) defined by an inner wall of the container 11 contains powder of a developer. A hole 13 is formed in a bottom 12 of the container 11. A part of the coupling 30 is inserted in the hole 13. In a circumference of the container 11 at an end close to the bottom 12, a developer outlet port 15 is formed to feed the developer to a reservoir tank (not shown). A shutter 16, which is reciprocally movable in circumferential directions of the container 11, is provided near the developer outlet port 15. The shutter 16 is closed when the toner cartridge 10 is detached from the image forming device. The shutter 16 is opened when the toner cartridge 10 is attached to the image forming device. As the cap 17 is inserted or engaged in an opening 14 of the container 11, the opening 14 is closed so that the container chamber in the toner cartridge 10 is enclosed.

The container 11 contains an conveyance member 20 which is substantially as long as the container chamber in a lengthwise direction of the container chamber, and has a slightly smaller outer diameter than an inner diameter of the container chamber. The conveyance member 20 is manufactured by subjecting of a resin material such as high- or low-density polyethylene to integral molding such as injection molding. An end of a rotation shaft 21 of the conveyance member 20 is connected to the coupling 30 inserted in the hole 13. A drive device (not shown) such as a motor provided in the image forming device (also not shown) drives the coupling 30 to rotate in a direction shown by an arrow D. Accordingly, the conveyance member 20 connected to the coupling 30 also rotates in the direction shown by the arrow D.

A-2. Structure of Conveyance Member 20

Figure 2:
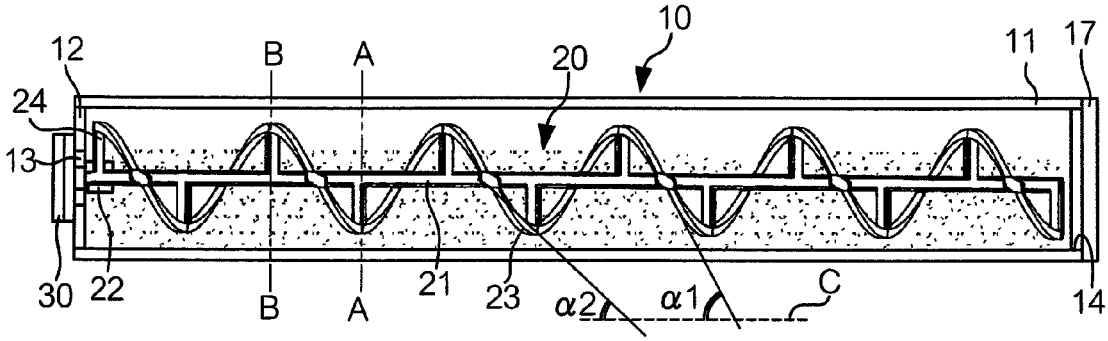
FIG. 2 is a side view of a developer container.

FIG. 2 is a side view of the toner cartridge 10. The structure of the conveyance member 20 will now be described in detail with reference to FIGS. 1 and 2.

The conveyance member 20 includes a rotation shaft 21, a spiral member 23, and stir plates 24 as an example of first connection parts. The rotation shaft 21 has a cross-shaped cross section. The spiral member 23 is provided to spirally extend about and along an axial direction of the rotation shaft 21. The stir plates 24 each connect the rotation shaft 21 to the spiral member 23, and stir the developer. The spiral member 23 has a slightly smaller outer diameter than an inner diameter of the container 11. Therefore, the outer circumference of the spiral member 23 is positioned to fit within the inner circumference of the container chamber when the conveyance member 20 is contained in the container chamber. An attachment part 22 to which the coupling 30 is attached is provided at an end of the rotation shaft 21. The developer is fed along an axial direction of the rotation shaft 21 from an end where the attachment part 22 is not provided, toward an opposite end where the attachment part 22 is provided. The former end of the rotation shaft 21 where the attachment part 22 is not provided is positioned in an upstream side along a feed direction of the developer, and will be hence referred to as an "upstream end". On the other side, the opposite end of the rotation shaft 21 where the attachment part 22 is provided is positioned in a downstream side along the feed direction of the developer, and will be hence referred to as a "downstream end".

Figure 3:
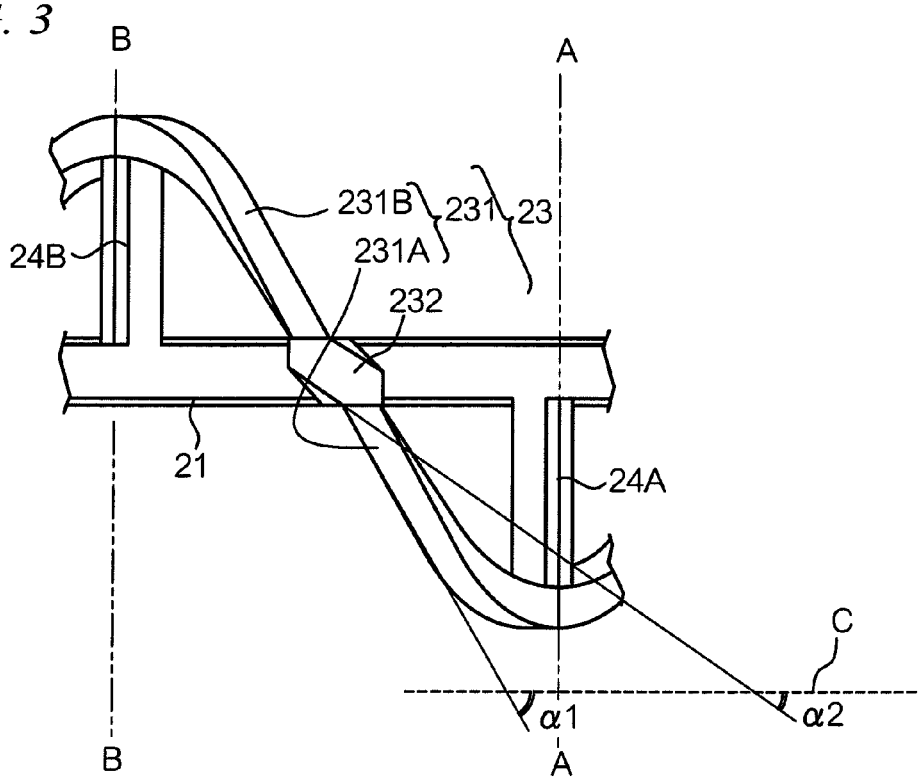
FIG. 3 is an enlarged side view of a specified segment shown in FIG. 2.

FIG. 3 shows an enlarged side view of a segment from a section A-A to a section B-B in FIG. 2. The spiral member 23 is provided so as to extend spirally about and along the rotation shaft 21. As shown in FIG. 3, the spiral member 23 includes high-angle portions 231 and low-angle portions 232 which are provided alternately along an axial direction of the rotation shaft 21. At least one low-angle portion 232 is provided in each segment of the spiral member 23 which corresponds to one turn of the spiral member about the rotation shaft 21. The low-angle portions 232 occupy a smaller percentage of a total volume of the spiral member 23 than the high-angle portions 23. For example, the low-angle portions 232 occupy 1 to 30% of the total volume of the spiral member in this embodiment. The high-angle portions 231 and the low-angle portions 232 have slightly different functions from each other. That is, the high-angle portions 231 are assigned to a main function of feeding a developer along an axial direction of the rotation shaft 21 when supplying the developer to the image forming device. On the other hand, the low-angle portions 232 are assigned to a main function of feeding and relaxing compacted toner in a rotation direction of the spiral member 23.

A-3. Structure of Spiral Member 23

Figure 4:
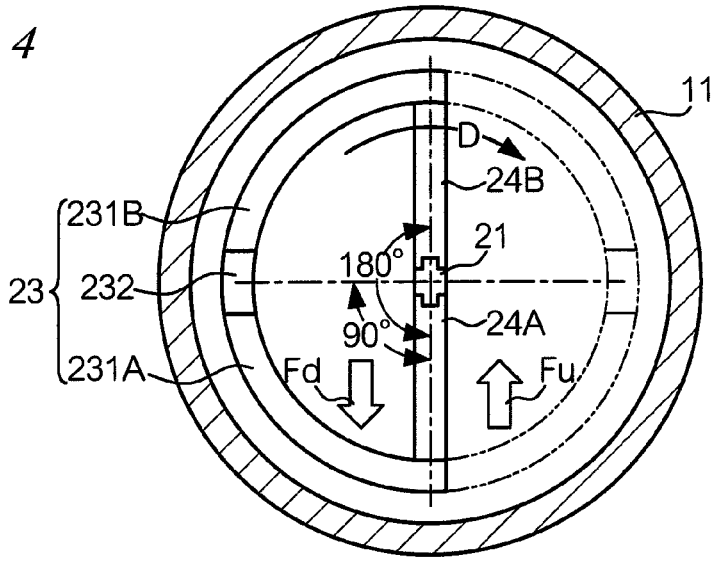
FIG. 4 is a cross-sectional view of a main part of the specified segment shown in FIG. 2, viewed from an upstream side in a feed direction.

FIG. 4 is a cross-sectional view showing a segment from the section A-A to the section B-B, and depicts the structure of the spiral member 23, when viewed from an upstream side along the feed direction of the developer. Referring to FIGS. 3 and 4, the segment from the section A-A to the section B-B will now be described.

As shown in FIG. 4, the spiral member 23 spirally extends in an axial direction of the rotation shaft 21, drawing a spiral arc about the rotation shaft 21. In the aforementioned segment, the spiral member 23 is constituted of high-angle portions 231A and 231B and a low-angle portion 232 sandwiched between the high-angle portions 231A and 231B. It will be assumed for convenience of explanation that the high-angle portions 231A and 231B have an equal volume, which is defined by evenly dividing the whole volume of one high-angle portion 231 by two. Angles of spirally extending directions of the high-angle portions 231A and 231B each are $\alpha 1$, which is an example of a first angle, to an axial direction c of the rotation shaft 21 (where the spirally extending direction is a direction of a tangent to an edge (ridges) forming the outside shape of each high-angle portion 231 at a junction between each high-angle portion 231 and a corresponding low-angle portion 232). An angle of an extending direction of the low-angle portion 232 is $\alpha 2$ to the axial direction c of the rotation shaft 21 (where the extending direction is a direction of a tangent to an edge forming the outside shape of the low-angle portion 232 at a junction between each high-angle portion 231 and the corresponding low-angle portion 232). As shown in FIG. 3, the angle $\alpha 2$ is smaller than the angle $\alpha 1$.

The spiral member 23 is supported by connection of the spiral member 23 to the rotation shaft 21 via stir plates 24A and 24B. The rotation shaft 21, spiral member 23, and stir plates 24A and 24B are rod-like members each of which has a specified thickness. Clearances exist between these members. The stir plate 24A is a substantially linear member provided in an upstream side along the feed direction within the aforementioned segment, and extends in a direction perpendicular to the rotation shaft 21. The stir plate 24B is a substantially linear member provided in a downstream side along the feed direction within the aforementioned segment, and extends in a direction perpendicular to the rotation shaft 21. When viewed in a direction parallel to the axial direction of the rotation shaft 21, an angle of 180 degrees is held between the stir plates 24A and 24B which are adjacent to each other in the axial direction of the rotation shaft 21, as shown in FIG. 4. In this case, the spirally extending direction of each high-angle portion 231 and the extending direction of the low-angle portion 232 are directions which are parallel to edges of inner or outer circumferences of these portions, in one side along the axial direction c.

A top end part of the stir plate 24A supports an end of the high-angle portion 231A. The other end of the high-angle portion 231 is connected to an end of the low-angle portion 232. Further, the other end of the low-angle portion 232 is connected to an end of the high-angle portion 231B. The other end of the high-angle portion 231B is supported by a top end part of the stir plate 24B. As has been described previously, the high-angle portions 231A and 231B are members having an equal volume. The low-angle portion 232 is therefore positioned in the center between the end of the high-angle portion 231A connected to the stir plate 24A and the end of the high-angle portion 231B connected to the stir plate 24B. The low-angle portion 232, two ends of which are connected respectively to the high-angle portions 231A and 231B, has a center located at a position where the center of the low-angle portion 232 is positioned at 90 degrees to each of centers of the stir plates 24A and 24B about the rotation axis, when viewed in the axial directions of the rotation shaft 21. That is, extending directions of the stir plates 24A and 24B from the rotation shaft 21 to the spiral member 23 are 90 degrees to a perpendicular line extended from the center of the low-angle portion 232 to the rotation shaft 21.

Plural (e.g., eleven in the example of FIG. 2) segments, each of which has the same configuration as the aforementioned segment, are connected to one another in the axial direction of the rotation shaft 21, shifted from one another by a phase difference of 180 degrees about the rotation shaft 21. Accordingly, an angle of 180 degrees is held between two perpendicular lines which are extended respectively from centers of two adjacent low-angle portions 232.

Since gravity acts on the developer filled in the container chamber, the developer is compacted more and more toward the lowermost position in the container chamber. As shown in FIG. 4, when the spiral member 23 rotates in a direction shown by an arrow D, the spiral member 23 receives an upward reaction force Fu in a lower right area in the figure due to an inertial force of the developer. At the same time, the spiral member 23 receives a downward reaction force Fd in a lower left area in the figure. In particular, the low-angle portions 232 function to loosen the developer while conveying the developer in a rotation direction of the spiral member 23. The low-angle portions 232 tend to be easily affected by the reaction forces Fu and Fd from the developer. Therefore, reaction forces acting in directions opposite to each other are transferred to a high-angle portion 231 sandwiched between each two adjacent low-angle portions 232 through each two adjacent low-angle portions 232, when the spiral member 23 is in a state that a line connecting each two adjacent low-angle portions 232 is horizontal (wherein the aforementioned each two adjacent low-angle portions 232 are those low-angle portions that are provided at 180 degrees to each other about the rotation shaft 21). In this state, there is accordingly a high possibility of deformation or cracking. The stir plates 24A and 24B function to dispersively distribute the reaction forces described above, which are transferred to the high-angle portions 231 (including 231A and 231B), further to the rotation shaft 21 in order to prevent deformation or cracking.

A-4. Developer Filing Method

A method for filling the toner cartridge 10 with an adequate amount of developer will now be described below.

In case of filling the toner cartridge 10 with a developer, the low-angle portions 232 are used as guidelines to know an amount of the developer to be filled. More specifically, a posture of the container 11 is held in a state in which the axial direction of the rotation shaft 21 of the conveyance member 20 is horizontal. The toner cartridge 10 is filled with such an amount of developer that causes any of the low-angle portions 232 of the spiral member 23 to be buried in the developer even during rotation of the conveyance member 20. The aforementioned state in which the axial direction of the rotation shaft 21 is horizontal is, in other words, a state in which the developer container is situated so that the rotation shaft 21 is parallel to a plane perpendicular to the direction of gravity. The low-angle portions 232 are provided at intervals of 180 degrees about the rotation shaft. Therefore, the amount of developer that causes any of the low-angle portions 232 to be buried in the developer is equivalent to a half or more of a total volume of the container chamber in the toner cartridge 10. Accordingly, the toner cartridge 10 is filled with an amount of developer which occupies a half or more of the total volume of the container chamber in the toner cartridge 10.

Alternatively, the developer may be filled so that both of two adjacent low-angle portions 232 are buried in the developer when the spiral member 23 is held in a state in which a line connecting centers of each adjacent two low-angle portions 232 is horizontal. Since the low-angle portions 232 each have a constant width and a specified length in the rotation direction of the spiral member 23, an amount of developer which allows both of two adjacent low-angle portions 232 (including the width) to be buried in the developer is greater than the half of the total volume of the container chamber in the toner cartridge 10. In this manner, the low-angle portions 232 can more frequently be in contact with the developer, and accordingly, the developer can be loosened more effectively.

However, it is desirable that the whole of the spiral member 23 is not buried in the developer. In a free space remaining in the container chamber which is not filled with the developer, reaction forces are not generated by motion of the spiral member 23. Therefore, the developer can be easily loosened in an initial drive state. In this configuration, the spiral member 23 pushes up the developer into the free space where the developer is surrounded by a gas such as air, which diffuses the developer in various directions. Accordingly, the developer is easily loosened. Further, presence of the free space, which generates no reaction forces, contributes to reduction of load to the spiral member 23.

A-5. Operation of Conveyance Member

Figure 5A:
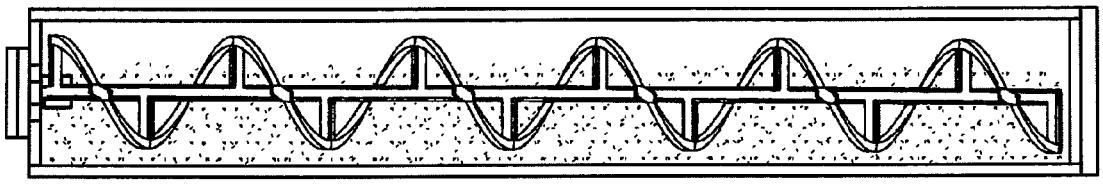
FIGS. 5A, 5B, and 5C are side views each of which depicts a state where an conveyance member rotates inside the developer container.
Figure 5B:
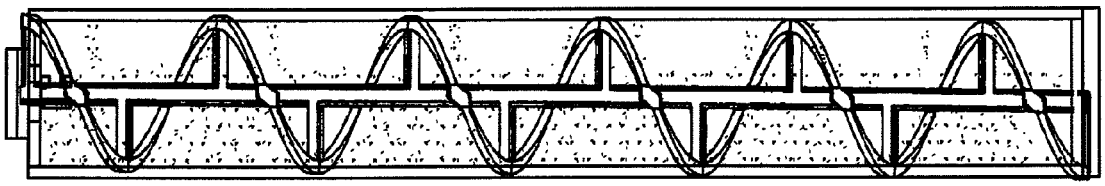
Figure 5C:
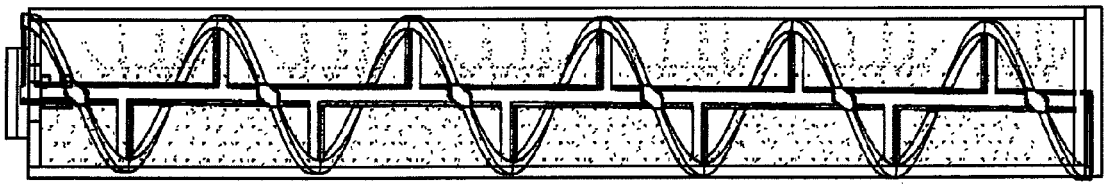

As described above, whenever the toner cartridge 10 is filled with an adequate amount of developer, any of the low-angle portions 232 of the spiral member 23 is buried in the developer. FIG. 5 are side views which depict states of rotary motion of the conveyance member 20. FIG. 5A shows a pre-drive state before the conveyance member 20 starts rotating. FIG. 5B shows an initial drive state immediately after the conveyance member 20 is started to rotate from a state where the developer is motionless as shown in FIG. 5A. FIG. 5C shows a normal drive state where the conveyance member 20 is kept rotating for a specified period. Dotted areas in FIGS. 5A to 5C each refer to a developer.

In the pre-drive state as shown in FIG. 5A, the developer filled in the toner cartridge 10 remains motionless. When the conveyance member 20 is rotated from this state, the low-angle portions 232 of the spiral member 23 rotate along the inner wall of the container chamber so that any of the low-angle portions 232 is always in contact with the developer. By means of all parts of the spiral member 23, the developer is moved in two directions which are the rotation direction and the axial direction c. However, the angle $\alpha 2$ of each low-angle portion 232 to the axial direction c of the rotation shaft 21 is smaller than the angle $\alpha 1$ of each high-angle portion 231 to the axial direction c of the rotation shaft 21. Accordingly, the low-angle portions 232 convey the developer more strongly in the rotation direction than in the axial direction c, compared with the high-angle portions 231.

Next, in the initial drive state as shown in FIG. 5B, the developer is not yet sufficiently loosened but is still compacted densely at a lower part in the container chamber. In this state, a greater reaction force than in the other states is therefore generated against a force which is acting to move the developer. On the other hand, a free space which is not filled with the developer still exists in an upper part of the container chamber in the initial drive state. In the free space, only a gas such as air exists. Therefore, the spiral member 23 receives relatively small reaction forces when the spiral member 23 moves from an area filled with the developer to the free space filled with no developer, e.g., when the spiral member 23 moves up beyond a surface of the developer in the rotation direction from downside. Accordingly, the developer is easily loosened particularly when each low-angle portion 232 comes out of the interface in the initial drive state. Further, stir plates 24 connecting the rotation shaft 21 to the spiral member 23 stir the developer so that the developer is loosened more effectively. Thus, the low-angle portions 232 loosen the compacted developer in the initial drive state immediately after the conveyance member 20 is started to rotate. In accordance with rotary motion of the conveyance member 20, a small amount of the loosened developer moves up and down in an area of the interface between the developer in the toner cartridge 10 and the free space above the developer.

The conveyance member 20 further continues rotating so that most of the developer is loosened and goes into the normal drive state. In the normal drive state, the loosened developer moves up and down in accordance with rotary motion of the conveyance member 20 throughout the aforementioned interface, as shown in FIG. 5C. As described previously, the angle of each high-angle portion 231 to the axial direction c of the rotation shaft 21 is greater than the angle of each low-angle portion 232. Therefore, the high-angle portions 231 tend to convey the developer more strongly in the axial direction c of the rotation shaft 21. Therefore, in the normal drive state, the developer which has been somewhat loosened in the initial drive state is conveyed to the downstream side along the feed direction in the container chamber by the high-angle portions 231. At this time, a reaction force acts on the high-angle portions 231 which are conveying the developer in the axial direction c. The reaction force most strongly acts on the center part of each high-angle portion 231. Therefore, the stir plates 24 are respectively connected to such positions of the high-angle portions 231 that are at 90 degrees relative to the low-angle portions 232 about the rotation axis, when viewed in the axial direction of the rotation shaft 21. This is because, at such positions, the spiral member 23 can be supported effectively against the most strongly acting reaction force.

B. Second Embodiment

B-1. Entire Structure of Toner Cartridge 1010

Figure 8:
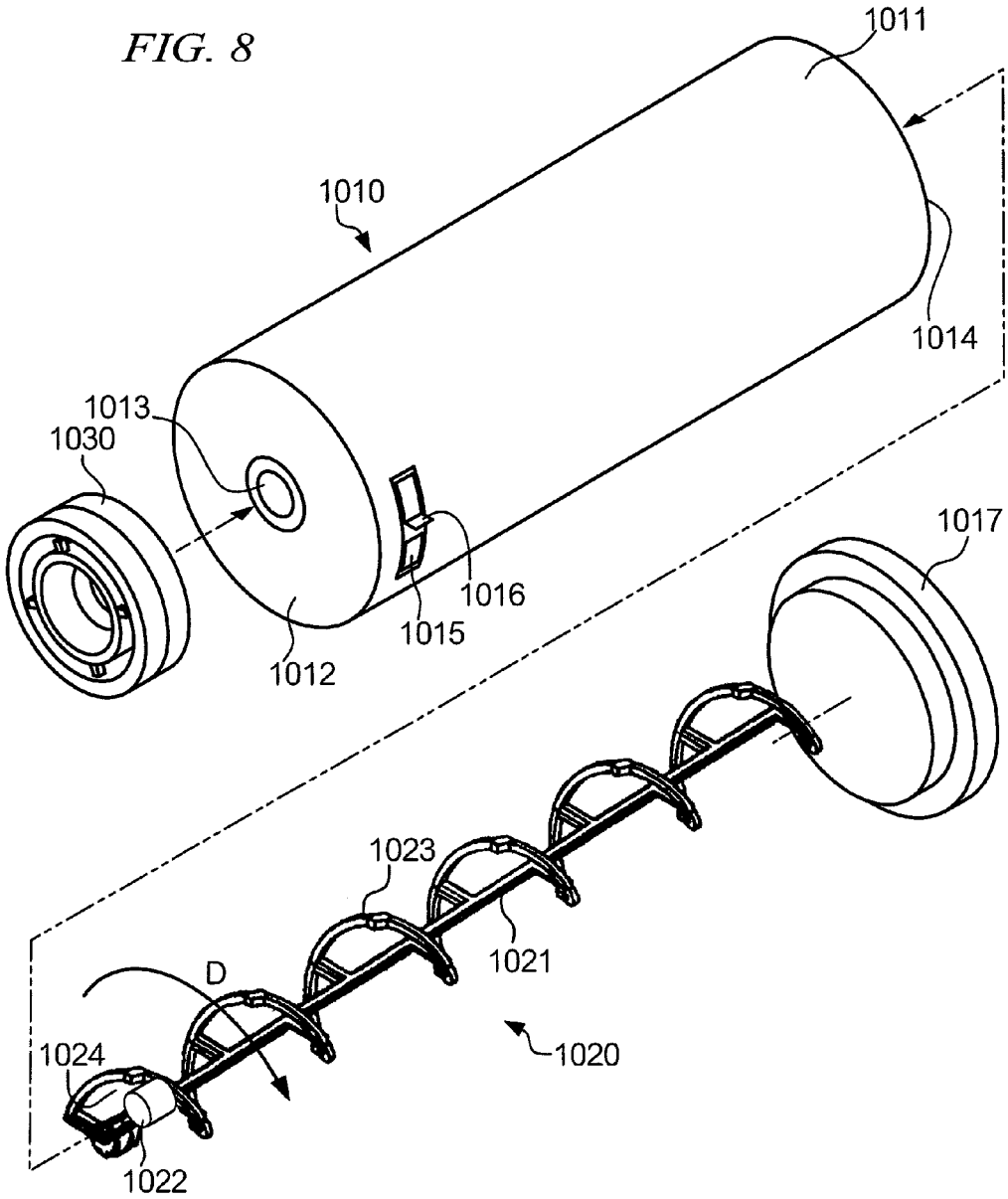
FIG. 8 is an exploded perspective view for explaining a structure of a toner cartridge as an example of a developer container.

FIG. 8 is an exploded perspective view showing a structure of a toner cartridge 1010 as an example of a developer container.

The toner cartridge 1010 includes a container 1011, a cap 1017, an conveyance member 1020 as an example of a conveyance member, and a coupling 1030. The toner cartridge 1010 is configured to be attachable/detachable to/from an image forming device, not shown. The container 1011 is a cylindrical member having a bottom and is molded from paper or plastics. A container space (hereinafter a container chamber) defined by an inside wall of the container 1011 contains powder of a developer. A hole 1013 is formed in a bottom 1012 of the container 1011. The coupling 1030 is partially inserted in the hole 13. In a circumference of the container 1011 at an end close to the bottom 1012, a developer outlet port 1015 is formed to feed the developer to a reservoir tank (not shown) of a developing device. A shutter 1016, which is reciprocally movable in circumferential directions of the container 1011, is provided near the developer outlet port 1015. The shutter 1016 is closed when the toner cartridge 1010 is detached from the image forming device. The shutter 1016 is opened when the toner cartridge 1010 is attached to the image forming device. As the cap 1017 is inserted or engaged in an opening 1014 of the container 1011, the opening 1014 is closed so that the container chamber in the toner cartridge 10 is enclosed.

The container 1011 contains an conveyance member 1020 which is substantially as long as the container chamber in a lengthwise direction of the container chamber and has a slightly smaller outer diameter than an inner diameter of the container chamber. The conveyance member 1020 is manufactured by subjecting of a resin material such as high- or low-density polyethylene to integral molding such as injection molding. An end of a rotation shaft 1021 of the conveyance member 1020 is connected to the coupling 1030 inserted in the hole 1013. A drive device (not shown) such as a motor provided in the image forming device (also not shown) drives the coupling 1030 to rotate in a direction shown by an arrow D. Accordingly, the conveyance member 1020 connected to the coupling 1030 also rotates in the direction shown by the arrow D.

B-2. Structure of Conveyance Member 1020

Figure 9:
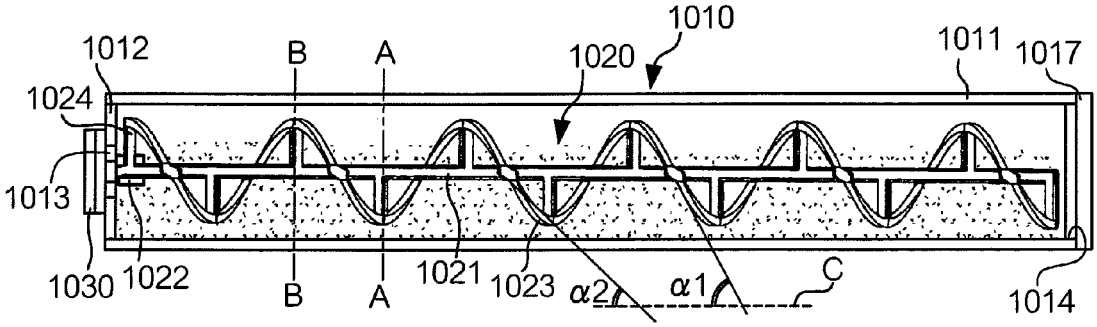
FIG. 9 is a side view of a toner cartridge.

FIG. 9 is a side view of the toner cartridge 1010. The structure of the conveyance member 1020 will now be described in detail with reference to FIGS. 8 and 9.

The conveyance member 1020 includes a rotation shaft 1021, an spiral member 1023, and support plates 1024. The rotation shaft 1021 has a cross-shaped cross section. The spiral member 1023 is provided to spirally extend about and along an axial direction of the rotation shaft 1021. The support plates 1024 each connect the rotation shaft 1021 and the spiral member 1023. The spiral member 1023 has a slightly smaller outer diameter than an inner diameter of the container 1011. Therefore, the outer circumference of the spiral member 1023 is positioned to fit within the inner wall of the container chamber when the conveyance member 1020 is contained in the container chamber. An attachment part 1022 to which the coupling 30 is attached is provided at an end of the rotation shaft 1021. The developer is fed along an axial direction of the rotation shaft 1021 from an end where the attachment part 1022 is not provided to an opposite end where the attachment part 1022 is provided.

Figure 10:
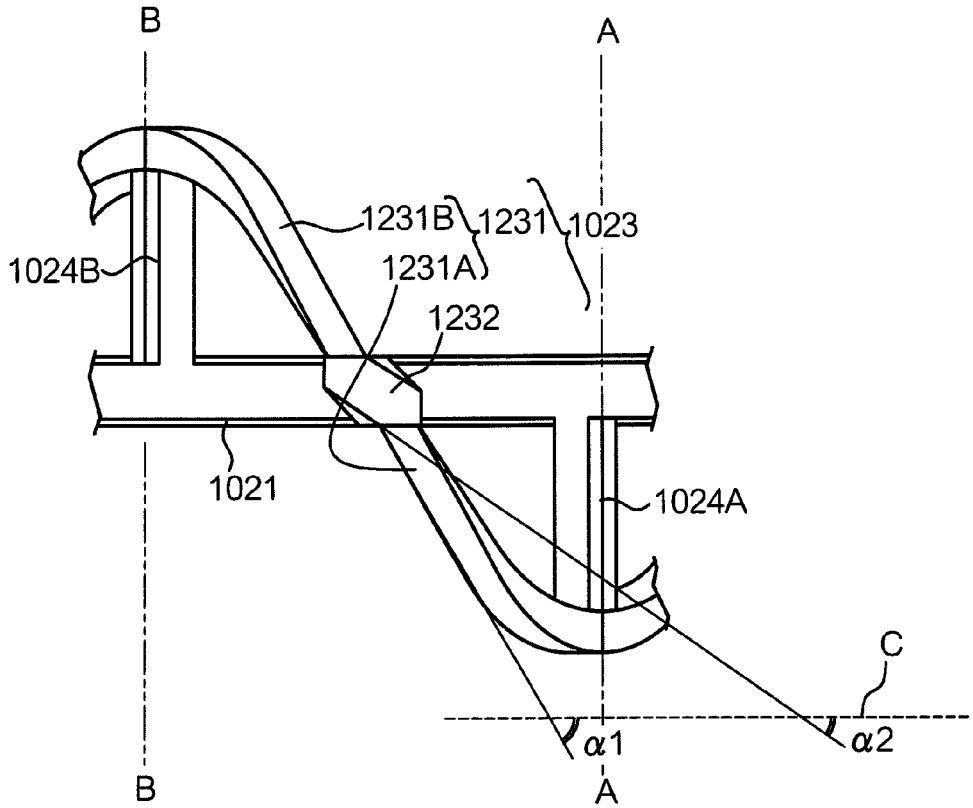
FIG. 10 is an enlarged side view of a specified segment shown in FIG. 9.

FIG. 10 shows an enlarged side view of a segment from a section A-A to a section B-B in FIG. 9. The spiral member 1023 is provided so as to extend spirally about and along the rotation shaft 1021. As shown in FIG. 10, the spiral member 1023 includes first portions 1231 (an example of high-angle portions) and second portions 1232 (an example of low-angle portions) which are provided alternately along an axial direction of the rotation shaft 1021. Although a percentage of a volume occupied by the second portions 1232 relative to the total volume of the spiral member 1023 is not particularly limited, the second portions 1232 occupy, for example, about 1 to 30% of the total volume of the spiral member 1023 in this embodiment B-3. Structure of Spiral Member FIG. 11 is a cross-sectional view showing a segment from the section A-A to the section B-B in FIG. 9 and depicts the structure of the spiral member 1023, when viewed from an upstream side along the feed direction. Referring to FIGS. 10 and 11, the segment from the section A-A to the section B-B in FIG. 9 will now be described.

As shown in FIG. 11, the spiral member 1023 spirally extends in an axial direction of the rotation shaft 1021, describing a spiral arc about the rotation shaft 1021. The spiral member 1023 is supported by connection of the spiral member 1023 to the rotation shaft 1021 through the support plates 1024A and 1024B. The rotation shaft 1021, spiral member 1023, and support plates 1024A and 1024B are rod-like members, each of which has a specified thickness. Clearances are held between these members. In the aforementioned segment, the spiral member 1023 is constituted of first portions 1231A and 1231B and a second portion 1232 sandwiched between the first portions 1231A and 1231B. It will be assumed, for convenience of explanation, that the first portions 231A and 231B have an equal volume which is defined by evenly dividing the whole volume of one first portion 1231 by two. Angles of spirally extending directions of the first portions 1231A and 1231B each are $\alpha 1$ to an axial direction c of the rotation shaft 1021. An angle of an extending direction of the second portion 1232 is $\alpha 2$ to the axial direction c of the rotation shaft 1021. As shown in FIG. 10, the angle $\alpha 2$ is smaller than the angle $\alpha 2$.

The support plate 1024A is a substantially linear member provided in an upstream side along the feed direction within the aforementioned segment, and extends in a direction perpendicular to the rotation shaft 1021. The support plate 1024B is a substantially linear member provided in a downstream side along the feed direction within the aforementioned segment, and extends also in a direction perpendicular to the rotation shaft 1021. An angle of 180 degrees is held between the stir plates 24A and 24B which are adjacent to each other in the axial direction of the rotation shaft 1021, when viewed in a direction parallel to the axial direction of the rotation shaft 1021, as shown in FIG. 11.

A top end part of the support plate 1024A supports an end of the first portion 1231A. The other end of the first portion 1231A is connected to an end of the second portion 1232. Further, the other end of the second portion 1232 is connected to an end of the first portion 1231B. The other end of the first portion 1231B is supported by a top end part of the support plate 1024B. As has been described previously, the first portions 1231A and 1231B are members having an equal volume. The second portion 232 is therefore positioned in the center between the end of the first portion 1231A connected to the support plate 1024A and the end of the first portion 1231B connected to the support plate 1024B. The second portion 1232, two ends of which are connected respectively to the first portions 1231A and 1231B, has a center located at 90 degrees to each of the support plates 1024A and 1024B about the rotation axis, when viewed in the axial direction of the rotation shaft 1021.

Plural (For example, eleven in the example of the figure) segments, each of which has the same configuration as the aforementioned segment, are connected to one another in an axial direction of the rotation shaft 1021, shifted from one another by a phase difference of 180 degrees about the rotation shaft 1021. In this manner, the spiral member 1023 is formed.

B-4. Reason that Second Portions 1232 are Provided

Reasons that the second portions 1232 are provided will now be described. The conveyance member 1020 has a function to convert rotary motion about the rotation shaft 1021 as a rotation center into linear motion in an axial direction of the rotation shaft 1021. To perform this function, the conveyance member 1020 is provided with the spiral member 1023. The spiral member 1023 provided with the second portions 1232 and another spiral member 1230 not provided with the second portions 1232 will be expressed below using an xyz coordinate system, and differences between these spiral members will also be described.

Figure 12:
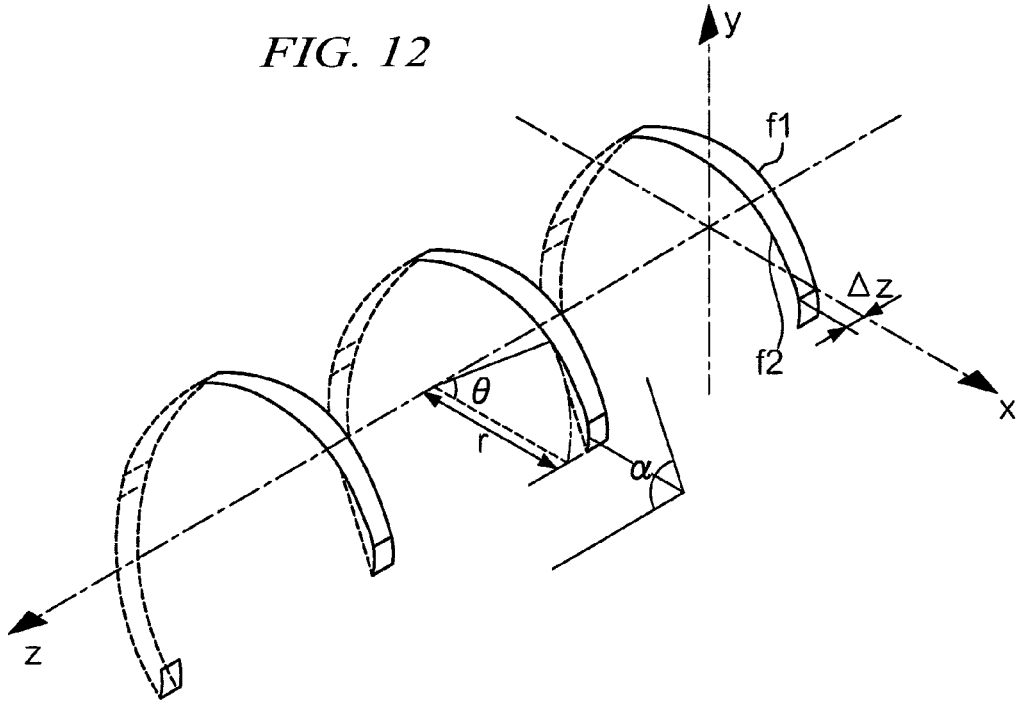
FIG. 12 is a perspective view showing an spiral member not provided with second portions.

FIG. 12 is a perspective view showing the spiral member 1230 not provided with the second portions 1232 on the xyz coordinate system. In FIG. 12, the spiral member 1023 and the spiral member 1230 are supposed to spirally extend in the z-axial direction of the xyz coordinate system. To simplify explanation, it is assumed in the following description that the spiral member 1230 has no thickness in a direction vertical to the z-axis. On this assumption, the spiral member 1230 is expressed as a spiral band defined between a curves f1 and f2. Edges of the spiral member 1230 are expressed as the curves f1 and f2. The curve f1 is one of the edges which is closer to the origin, and the curve f2 is the other one of the edges. A distance $\Delta z$ is held between the curves f1 and f2 in the z-axial direction. The symbol $\Delta z$ refers to a thickness of the spiral member 1230 in the z-axial direction. $\theta$ refers to an angle between the x-axis and a perpendicular line which is extended to the x-axis from an arbitrary point on the spiral member 1230, when viewed in a direction parallel to the z-axial direction. Further, r refers to a distance between the spiral member 1230 and the z-axis. That is, r represents the diameter of the spiral of the spiral member 1230, and is an arbitrary constant in this case. $\alpha$ refers to an angle between the z-axis and a tangent to the curve f1 at an arbitrary point on the curve f1 of the spiral member 1230, when viewed in a direction parallel to a perpendicular line extended from the arbitrary point to the z-axis. That is, $\alpha$ refers to an angle of the spiral member 1230 to an axial direction of the rotation shaft 1021, and is an arbitrary constant.

Figure 13:
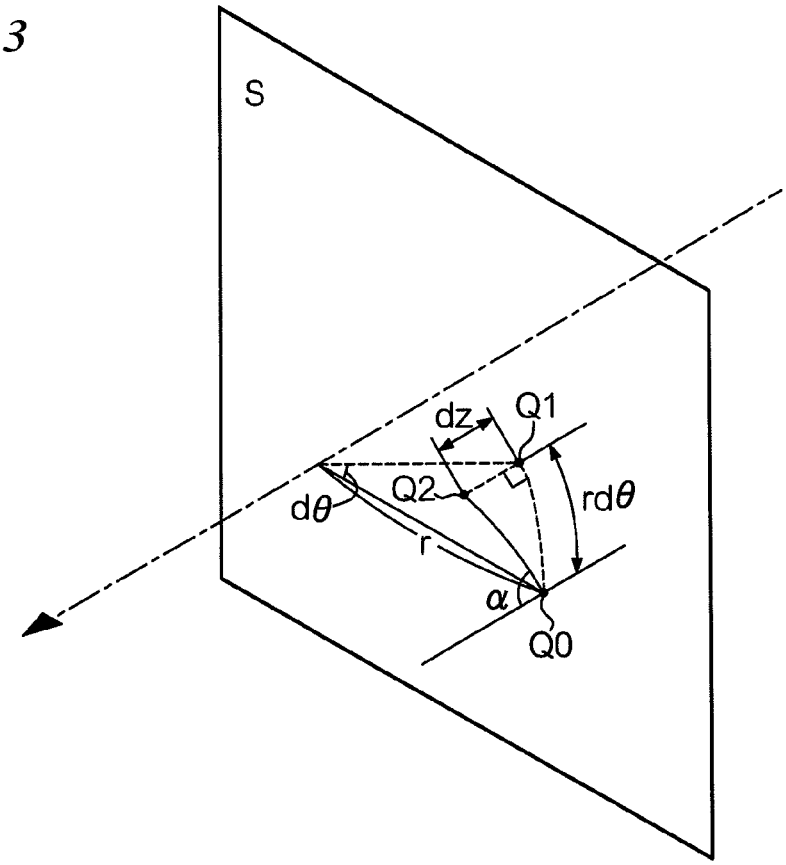
FIG. 13 is an enlarged perspective view of a very small part of an spiral member.

FIG. 13 is an enlarged perspective view of a very small part of the curve f1. As shown in the figure, if the angle $\theta$ mentioned above shifts by $d\theta$, an arbitrary point Q0 on the curve f1 shifts to a point Q1. A plane S contains the point Q0 and is vertical to the z-axis. A point Q2 is obtained by orthogonally projecting the point Q1 onto the plane S. Accordingly, a locus (hereinafter referred to as an arc Q0Q1) from the point Q0 to the point Q1 is orthogonally projected to a locus (hereinafter referred to as an arc Q0Q2) from the point Q0 to the point Q2. At this time, the length of the arc Q0Q2 is obtained as a length of an arc having a radius r and an interior angle $d\theta$, i.e., $r \cdot d\theta$. Where a shift amount of the arc Q0Q1 in the z-axial direction (i.e., the length of a line segment connecting the points Q2 and Q1) is dz, the angle $\alpha$, dz, and $d\theta$ satisfy a relationship of the equation (1) as follows.

$$r \cdot d\theta / dz = \tan \alpha \quad (1)$$

The equation (1) is integrated provided that the curve f1 gives z=0 where $\theta=0$. Then, the curve f1 is expressed by the following equation (2) on the xyz coordinate system.

$$x = r \cos \theta$$

$$y = r \sin \theta$$

$$z = (r / \tan \alpha) \cdot \theta \quad (2)$$

The curve f2 is also expressed by the following equation (3) on the xyz coordinate system.

$$x=r\cos\theta$$

$$y=r\sin\theta$$

$$z=(r/\tan\alpha)\cdot\theta+\Delta z \quad (3)$$

Figure 14A:
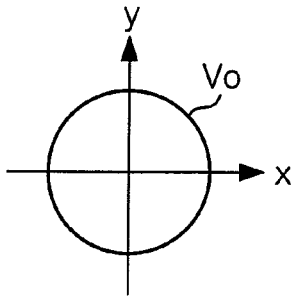
FIGS. 14A and 14B are to explain conditions of a metal mold for holding a spiral shape.
Figure 14B:
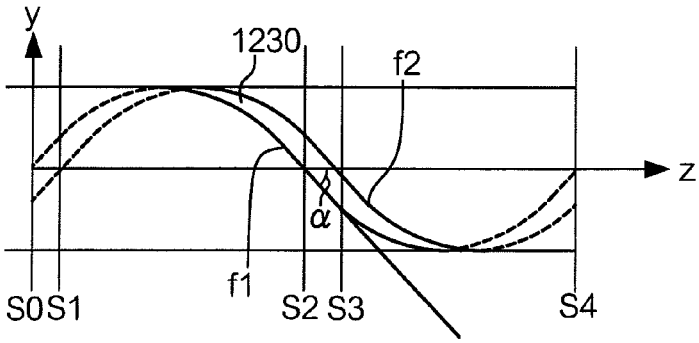

There are two methods for molding resin materials. One of the methods is an injection molding in which molding is carried out by injection of a thermoplastic resin which liquefies by heating into a metal mold under a high temperature and a high pressure. The other method is a cast molding in which a hardening agent is mixed into a resin which liquefies under a normal temperature, and the resin mixed with the hardening agent is poured into a metal mold under a normal temperature and a normal pressure. The resin mixed with the hardening agent thereby causes a polymerization reaction, and accordingly, molding is completed. In any of these methods, a liquid material needs to be held in a specified shape for a constant time period by a metal mold, and a molded product needs to be separated from the metal mold. As has been described above, the distance r between the spiral member 1230 and the z-axis is a constant. Therefore, the metal mold for holding the spiral member 1230 from inside has a shape of a round column V0 about the z-axis as a center. FIG. 14A shows a cross-section of the round column V0 cut along the xy-plane. FIG. 14B is a side view of the spiral member 1230 formed around the round column V0, when viewed in a direction parallel to the z-axial direction. In FIG. 14, there are assumed to be planes S0, S1, S2, S3, and S4 which are vertical to the z-axis. The curve f1 of the spiral member 1230 intersects the plane S0 vertical to the z-axis at $\theta=0$, intersects the plane S2 vertical to the z-axis at $\theta=\pi$, and intersects the plane S4 vertical to the z-axis at $\theta=2\pi$. The curve f2 of the spiral member 1230 intersects the plane S1 vertical to the z-axis at $\theta=0$, and intersects the plane S3 vertical to the z-axis at $\theta=\pi$.

Consideration will now be made as to whether or not the round column V0 can be divided by the planes S0, S1, S2, S3, and S4 into divisional parts each of which can then be extended in any of positive and negative y-axial directions. In a space defined between the planes S1 and S2, the spiral member 1230 does not exist within an area where the y-component is negative. Therefore, a divisional part of the round column V0 between the planes S1 and S2 can be extended downwardly (i.e., in the negative y-axial direction). Similarly, in a space defined between the planes S3 and S4, the spiral member 1230 does not exist within an area where the y-component is positive. Therefore, a divisional part of the round column V0 between the planes S3 and S4 can be extended upwardly (i.e., in the negative y-axial direction).

On the other hand, in a space defined between the planes S0 and S1, the spiral member 1230 exists within both of an area where the y-component is positive and an area where the y-component is negative. Therefore, a divisional part of the round column V0 between these planes cannot be extended in any of the positive and negative y-axial directions. This is because the spiral member 1230 exists in both the directions of extension of the divisional parts.

As has been described above, if the whole of the spiral member 1230 is formed within a spiral shape, a part of a round column V0 as a metal mold provided inside the spiral member 1230 to be formed cannot be extended in any y-axial direction. Hence, the spiral member 1023 is improved so as to include two different portions. Specifically, the two different portions are first portions 1231 formed of spirally curved faces as in the spiral member 1230, and second portions 1232 formed of flat surfaces, for the following reasons.

Figure 15A:
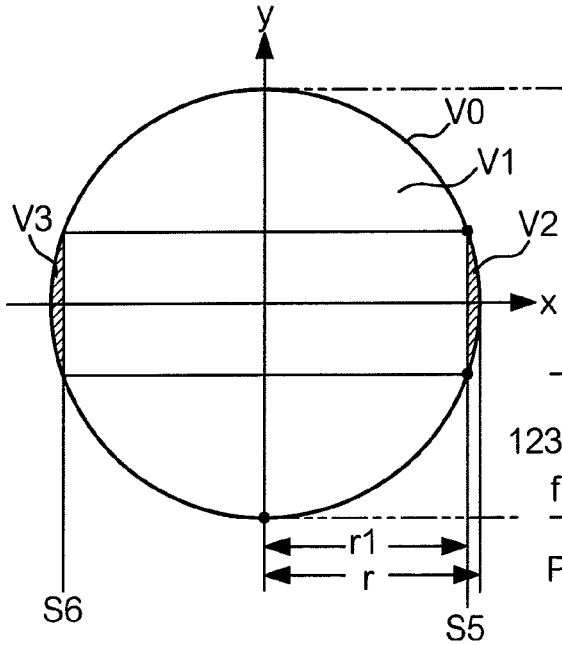
FIGS. 15A and 15B are to explain an spiral member.

FIG. 15A shows a cross section of a part of a metal mold for molding the spiral member 1023, cut along the xy-plane.

The metal mold shown in FIG. 15A is a solid V1 having a shape defined by dividing the aforementioned round column V0 by two planes S5 and S6 vertical to the x-axis into solids V1, V2, and V3 and by further removing the solids V2 and V3 from the V0. The x-component of the plane S5 is "r1", and the x-component of the plane S6 is "−r1". The "r1" is smaller than the radius r of the round column V0. Since the solids V2 and V3 are symmetrical to each other about the origin, the following description is made only of the solid V2, and the solid V3 is omitted from the description. The planes S5 and S6 are both vertical to the x-axis and are therefore parallel to each other. Faces of the solid V1 cut along the planes S5 and S6 are parallel to each other. Accordingly, portions of the spiral member 1023 which are molded by the faces of the solid V1 are linear and extend in directions parallel to each other, when viewed in a direction parallel to the z-axial direction.

Figure 15B:
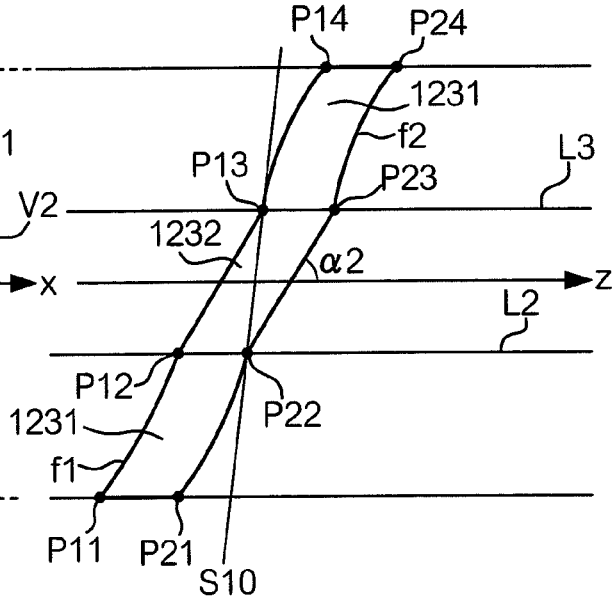

FIG. 15B is an enlarged side view of a part of the spiral member 1023 formed around the solid V1, when viewed in a direction parallel to the x-axial direction. Points P11, P12, P13, and P14 shown in FIG. 15B are on the curve f1. Points P21, P22, P23, and P24 are on the curve f2. FIG. 15B depicts an area surrounded by these points, when viewed from inside of the spiral shape of the spiral member. In a part sandwiched between lines L2 and L3 parallel to the z-axis, the solids V1 and V2 are divided from each other by the plane S5. The y-component of the line L2 is $-(r^2-r1^2)^{1/2}$, and the y-component of the line L3 is $(r^2-r1^2)^{1/2}$.

The spiral member 1023 has contact with the line L2 at the points P12 and P22. The point P12 has a smaller z-component than the point P22. The spiral member 1023 has contact with the line L3 at the points P13 and P23. The point P13 has a smaller z-component than the point P23. An area surrounded by the points P12, P13, P23, and P22, which is a second portion 1232, is a part molded by a plane segmented by the lines L2 and L3. A line segment connecting the points P12 and P13 and a line segment connecting the points P22 and P23 correspond respectively to edges of the second portion 1232. These edges each have an angle of $\alpha 2$ to the z-axis.

On the other hand, an area surrounded by the points P11, P12, P22, and P21 and an area surrounded by the points P13, P23, P24, and P14, which are first portions 1231, are molded held on curved faces of the solid V1. A line segment connecting the points P11 and P12, a line segment connecting the points P13 and P14, a line segment connecting the points P21 and P22, and a line segment connecting the points P23 and P24 correspond to edges of the first portions 1231. These edges have an angle of $\alpha 1$ to the z-axis.

Since the second portions 1232 are parallel to the y-axis, the solid V1 having contact with the second portions 1232 can be extended in both of positive and negative y-axial directions. On the other side, parts of the first portions 1231 which are positioned below the second portions 1232 in the negative y-axial direction exist in an area where the y-component is negative. Therefore, the solid V1 having contact with such parts of the first portions 1231 cannot be extended in the negative y-axial direction. Similarly, parts of the first portions 1231 which are positioned above the second portions 1232 in the positive y-axial direction exist in an area where the y-component is positive. Therefore, the solid V1 having contact with such parts cannot be extended in the negative y-axial direction. As a consequence, a part of the solid V1 which has contact with the line segment between P12 and P22 of a second portion 1232 needs to be extended in the positive y-axial direction. A part of the solid V1 which has contact with the line segment between P13 and P23 of the second portion 1232 needs to be extended in the negative y-axial direction. Thus, the solid V1 includes parts which need to be extended respectively in different directions. The solid V1 therefore needs to be configured so that the solid V1 is divided by a plane S10 which extends through the line segment P13-P22 as a diagonal line of a second portion 1232.

B-5. Relationship Between Δz and Angle α2 of Second Portions 1232

As has been described previously, there are provided linear second portions 1232 which extend in directions substantially parallel to each other, when viewed in a direction parallel to an axial direction of the rotation shaft 1021. Further, there is employed a metal mold by which the spiral member 1023 is divided by a plane S10 positioned on the second portions 1232, when viewed in a direction vertical to the axial direction of the rotation shaft 1021. Therefore, the metal mold can be extended from inside of the spiral member 1023.

However, there is a case that the plane S10 extending through the line segment P13-P22 has an angle of more than 90 degrees to the z-axis, depending on a relationship in size between the aforementioned angle and Δz which indicates a thickness of the spiral member 1230 in the z-axial direction. In this case, even if the metal mold is divided by the plane S10, the metal mold cannot be extended from inside of the spiral member 1023 for the following reasons.

Figure 16A:
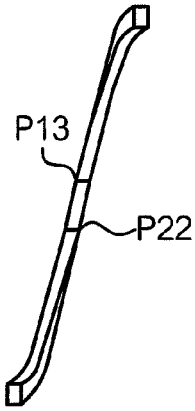
FIGS. 16A, 16B, and 16C show an example of a configuration in which second and first portions of an spiral member are connected in smooth continuity with each other.
Figure 16B:
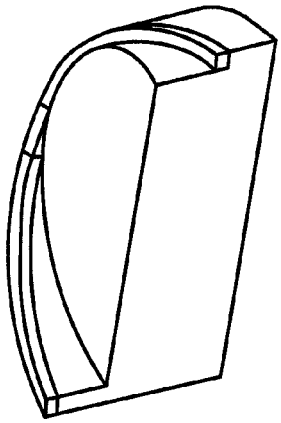
Figure 16C:
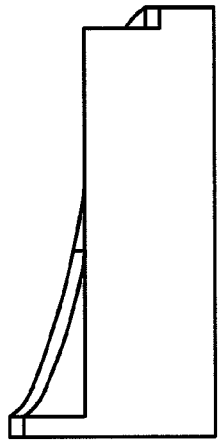

FIG. 16A is a side view showing inside of the spiral member 1023 viewed in a direction parallel to the x-axis in a case where the angle α1 of each first portion 1231 to an axial direction of the rotation shaft 1021 is equal to the angle α2 of each second portion 1232 to the axial direction of the rotation shaft 1021. FIG. 16B is a perspective view showing a state in which the spiral member 1023 shown in FIG. 16A is combined with a metal mold for molding the spiral member 1023. FIG. 16C is a cross-sectional view cut along a plane containing a rotation axis of the spiral member 1023, showing the same state as shown in FIG. 16B in which the spiral member 1023 is combined with a metal mold.

If the angle α1 of each first portion 1231 of the spiral member 1023 to the z-axis is large, there is a case that the z-component of the point P13 shown in FIG. 15B is smaller than the z-component of the point P22. In this case, if the solid V1 is divided into two solids by a plane extending through the line segment P13-P22, the two divided solids bite each other in directions of respectively extending the two solids, thereby preventing the divided solids from being extended. Consequently, the divided solids cannot be extended in any of the positive and negative y-axial directions.

Figure 17A:
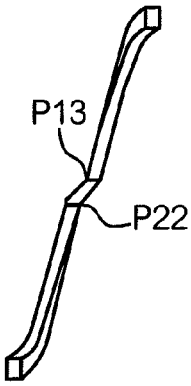
FIGS. 17A, 17B, and 17C show an example of a configuration in which second and first portions of an spiral member are connected to each other without smooth continuity.
Figure 17B:
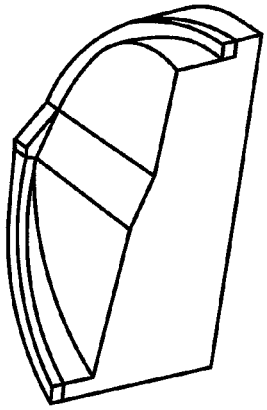
Figure 17C:
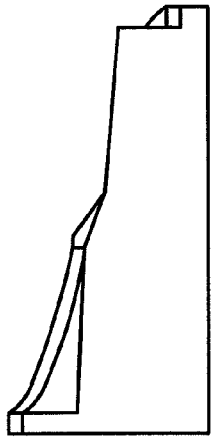

FIG. 17A is a side view showing inside of the spiral member 1023 viewed in a direction parallel to the x-axis in case where the angle α1 of each first portion 1231 to an axial direction of the rotation shaft 1021 is smaller than the angle α2 of each second portion 1232 to the axial direction of the rotation shaft 1021. FIG. 17B is a perspective view showing a state in which the spiral member 1023 shown in FIG. 17A is combined with a metal mold for forming the spiral member 1023. FIG. 17C is a cross-sectional view cut along a plane containing a rotation axis of the spiral member 1023, showing the same state as shown in FIG. 17B in which the spiral member 1023 is combined with a metal mold. In FIG. 17, the relationship between Δz and the angle α2 is designed so that the z-component of the point P13 is always greater than the z-component of the point P22. As a result, if the solid V1 is divided by a plane extending through the line segment P13-P22, two divided solids do not bite each other in directions of respectively extending the divided solids. Accordingly, the two divided solids each can be properly extended from the spiral member 1023.

In order to extend the solid V1 as a metal mold from the spiral member 1023 as described above, the angle α2 and Δz need to satisfy the expression 4 as follows.

$$\Delta z \leqq 2\cdot(r^2-r1^2)^{1/2}/\tan\alpha 2 \quad (4)$$

Figure 18A:
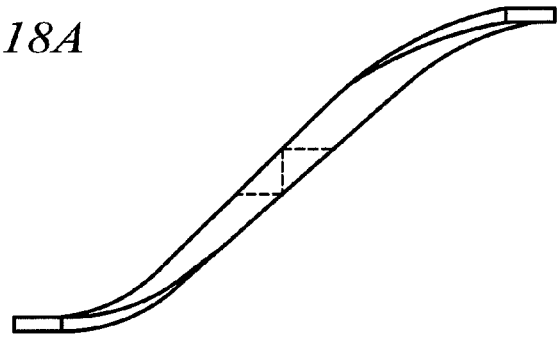
FIGS. 18A and 18B show an example of a configuration in which second and first portions are connected in smooth continuity with each other.
Figure 18B:
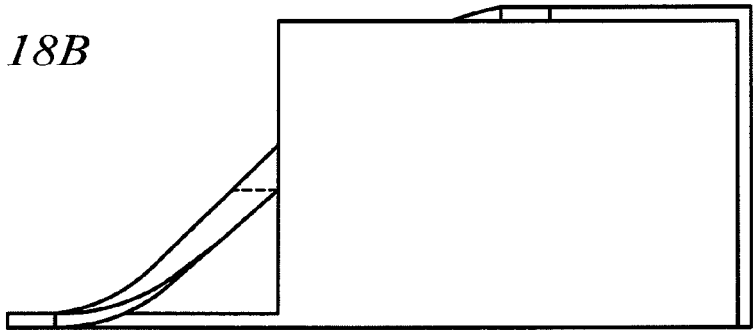

FIG. 18A is a side view showing inside of the spiral member 1023 viewed in a direction parallel to the x-axis in case where the angle α1 is equal to the angle α2 and the z-component of the point P13 is greater than the z-component of the point P22. FIG. 18B is a cross-sectional view cut along a plane containing a rotation axis of the spiral member 1023, showing a state in which the spiral member 1023 shown in FIG. 18A is combined with a metal mold for forming the spiral member 1023. If the angle α1 (=angle α2) is sufficiently small relative to Δz, two solids divided by a plane extending through the line segment P13-P22 do not bite each other in directions of respectively extending the divided solids. Accordingly, the two divided solids each can be extended in one of positive and negative y-axial directions. That is, according to the second embodiment, the angle of each second portion 1232 provided in the spiral member 1023 to the axial direction c of the rotation shaft 1021 need not always be smaller than the angle α1 of each first portion 1231 to the axial direction c. Second portions 1232 need only to extend linearly in directions parallel to each other, when viewed in a direction parallel to the axial direction of the rotation shaft 1021.

B-6. Structure of Metal Mold

In case of molding the spiral member 1023 only, a metal mold which is constituted of a solid V1 having a shape as described above needs only to be extended from inside of the spiral member 1023. However, if the spiral member 1020 is connected to the rotation shaft 1021 through the support plates 1024, the rotation shaft 1021 and the support plates 1024 need to be molded inside the solid V1.

Figure 19A:
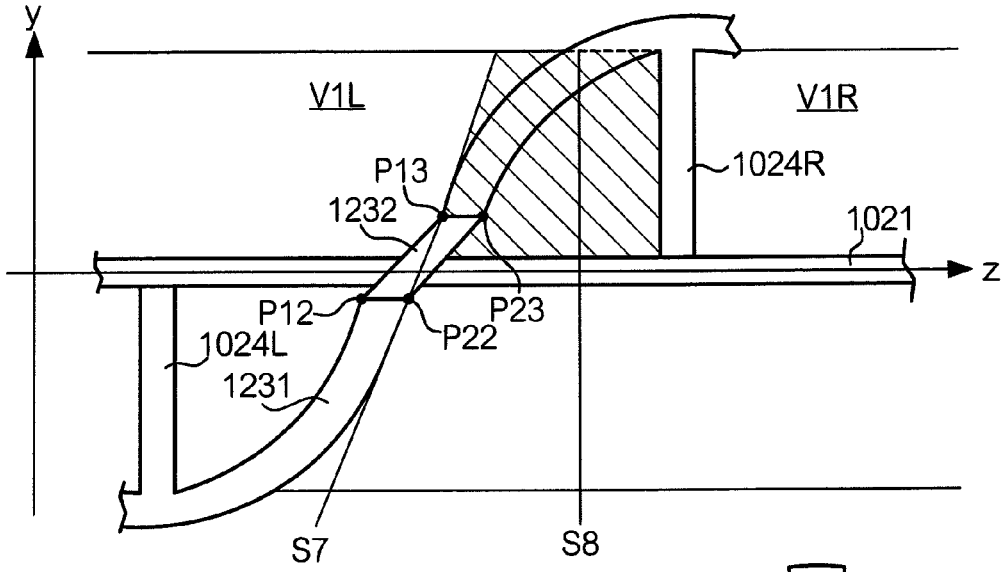
FIGS. 19A and 19B are to explain a metal mold for molding a rotation shaft and support plates.

FIG. 19 depict a mold for molding the rotation shaft 1021 and support plates 1024 as described above. As shown in FIG. 19A, a plane S7 extends through points P13 and P22 of a second portion 1232 and is parallel to the x-axis. A solid V1 is divided into solids V1L (left side in the figure) and V1R (right side in the figure) by the plane S7. The solids V1L and V1R are symmetrical to each other, and therefore, only the solid V1R will be described below. The solid V1R is a part of a metal mold which is to be extended downwardly to the negative side of the y-axis. However, an area (hatched by oblique lines in the figure) up to a support plate 1024R cannot be extended downwardly because of the rotation shaft 1021 existing in the downside.

Figure 19B:
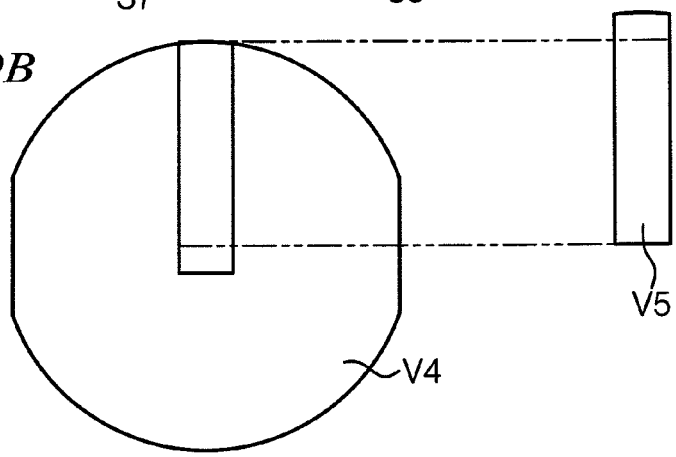

FIG. 19B is a cross-sectional view of the solid VIR cut along a plane S8 vertical to the z-axis intersecting the area (hatched by oblique lines) mentioned above. A solid V5 shown in the figure is a part of the solid V1R, and obtained by cutting out an area from the solid V1R. This area to be cut out has a width equal to a width of the rotation shaft 1021 in the x-axial direction, and the y-component of the area is positive. Further, a solid V4 is obtained by removing the solid V5 from the solid V1R. After the solid V4 is extended downwardly, the solid V5 can be extended upwardly in a direction moving away from the support plate 1024R.

Thus, the solid V1R is further divided into the solids V4 and V5. In this manner, the metal mold can be separated from a conveyance member which is constituted of an spiral member 1023 formed integrally with a rotation shaft 1021 and support plates 1024.

As has been described above, the solid V1R is divided into the solids V4 and V5, which can then be extended downwardly and upwardly, respectively. Similarly, the solids V1L is divided into solids which can be extended upwardly and downwardly, respectively. Accordingly, divided solids of each of the solids V1L and V1R can be metal molds which are separate depending on extended directions.

Figure 20:
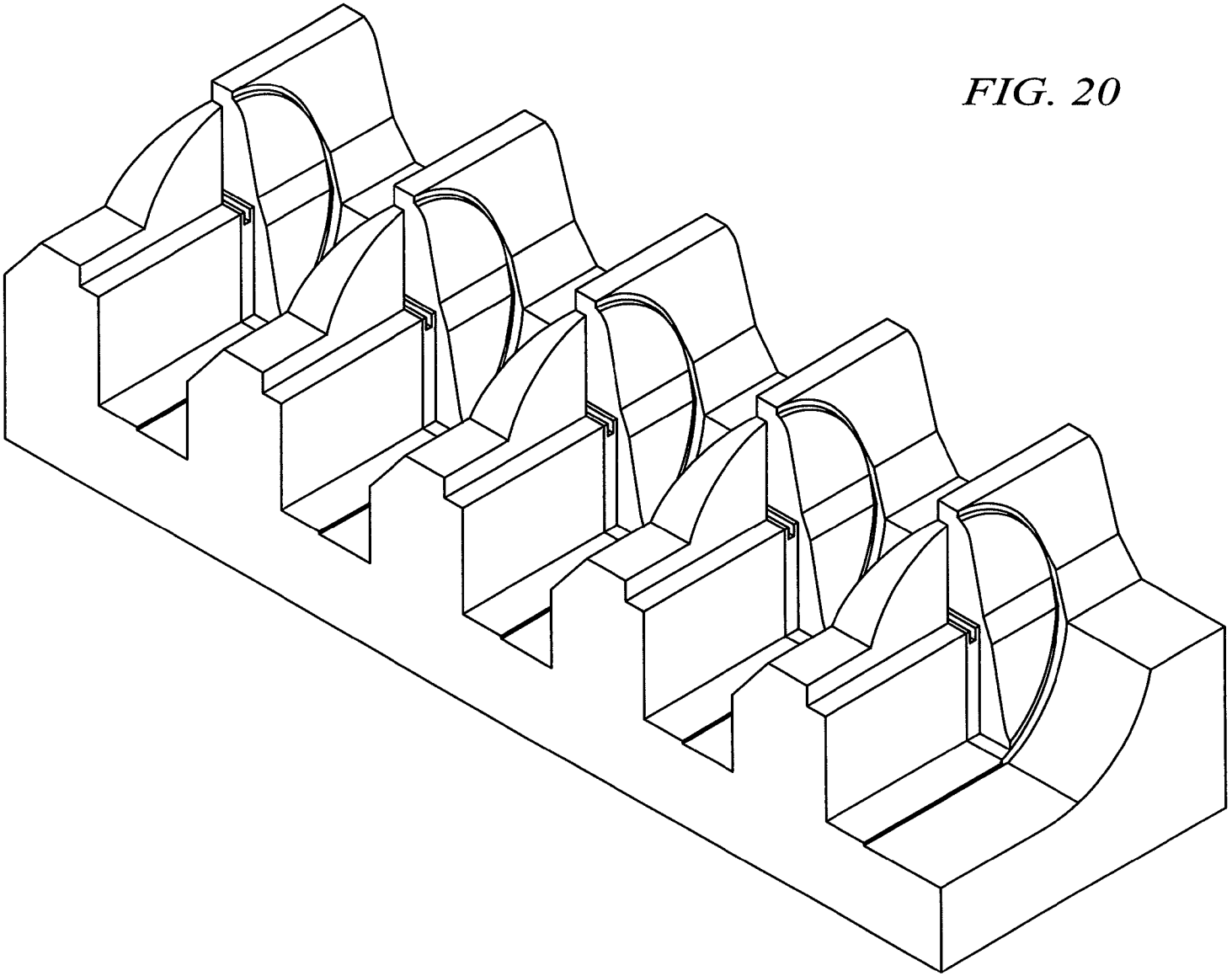
FIG. 20 is a perspective view showing parts of a metal mold which are extended downwardly.

FIG. 20 is a perspective view showing parts which are extended downwardly from metal molds as solids described above. As shown in this figure, the metal molds have, as a whole, a shape like a saw-tooth. These molds and molds to be extended upwardly are engaged with each other from downside and upside, respectively, to form one mold for the conveyance member 1020.

B-7. Operation and Function of Support Plates

Operation and functions of the support plates 1024 will now be described, referring back to FIG. 11. As has been described previously, the spiral member 1023 includes first portions 1231 and second portions 1232. The spiral member 1023 is molded so that the angle $\alpha 2$ of each second portion 1232 to an axial direction of the rotation shaft 1021 is smaller than the angle $\alpha 1$ of each first portion 1231 to the axial direction of the rotation shaft 1021.

Since gravity acts on a developer filled in the container chamber, the developer is compacted more and more toward the lowermost position in the container chamber. As shown in FIG. 11, when the spiral member 1023 rotates in a direction shown by an arrow D, the spiral member 1023 receives an upward reaction force in a direction opposite to the direction shown by the arrow D due to an inertial force of the developer. For example, in a right area in the figure, the spiral member 1023 receives a reaction force Fu which totally acts upward. In a left area in the figure, the spiral member 1023 receives a reaction force Fd which totally acts downward.

The second portions 1232 have a smaller angle to an axial direction of the rotation shaft 1021 than the first portions 1231. Therefore, a face of each second portion 1232 which pushes the developer when the spiral member 1023 rotates in the direction shown by the arrow D has a much closer normal vector to the direction shown by the arrow D than a face of each first portion 1231 which presses the developer as well. Accordingly, the second portions 1232 tend to be easily affected by the reaction forces Fu and Fd from the developer. Particularly, as shown in FIG. 11, the reaction forces acting in opposite directions to each other are transferred to the first portion 231 sandwiched between each two adjacent second portions 1232, when the spiral member 1023 is in a state that a line connecting centers of each two adjacent second portions 1232 is horizontal (wherein each two adjacent second portions 1232 are positioned at 180 degrees to each other about the rotation axis). In this state, there is accordingly a high possibility of deformation or cracking. Since the support plates 1024A and 1024B extend in directions parallel to directions of the reaction forces Fu and Fd, the support plates 1024 function to receive and bear the reaction forces which are transferred to the first portions 1231 (including 1231A and 1231B), in order to prevent deformation or cracking.

C. Third Embodiment

Subsequently, a third embodiment of the invention will be described. The structure and operation of the third embodiment have a lot of common features with the second embodiment. Therefore, the following description will be made only of differences of the third embodiment to the second embodiment, and common features will be omitted herefrom.

At first, the third embodiment differs from the second embodiment in that the round column V0 is just the solid V1 as a metal mold which holds the spiral member 1023 from inside. That is, in the third embodiment, the first portions 1231 and second portions 1232 are all shaped spirally.

The third embodiment also differs from the second embodiment in that the plane S10 which divides the solid V1 into the solids V1L and VIR does not extend through the diagonal line P13-P22 of each second portion 1232.

Figure 21:
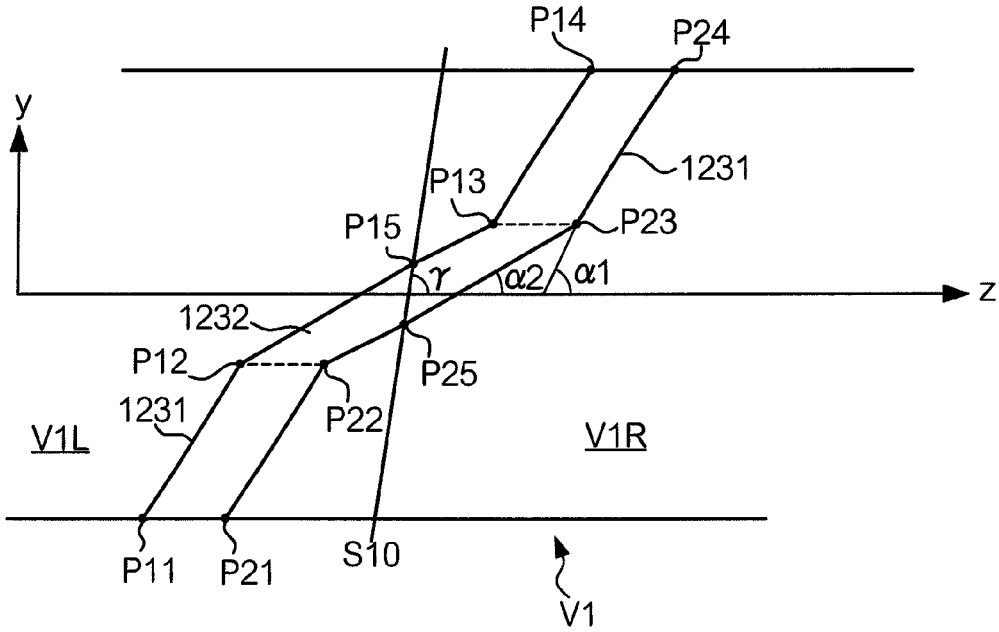
FIG. 21 shows a relationship between a plane which divides a metal mold and a second portion of an spiral member, according to the second embodiment.

FIG. 21 shows a relationship between the plane S10, which divides the solid V1 into the solids V1L and V1R, and a second portion 1232 of the spiral member 1023. As shown in FIG. 21, the second portion 1232 contains a point P15 as a point on a line connecting points P12 and P13, and a point P25 as a point on a line connecting points P22 and P23. In the third embodiment, the plane S10 which divides the solid V1 extends through a line connecting the points P15 and P25. At this time, the solid V1 is divided into solids V1L and V1R by the plane S10 as a boundary. As shown in the figure, an angle Y between the z-axis and the line connecting the points P15 and P25 is an acute angle (90>Y>0) or 90 degrees. Therefore, the solids V1L can be extended upwardly (toward a positive side along the y-axis) and the solid V1R can be extended downwardly (toward a negative side of the y-axial direction).

Figure 22:
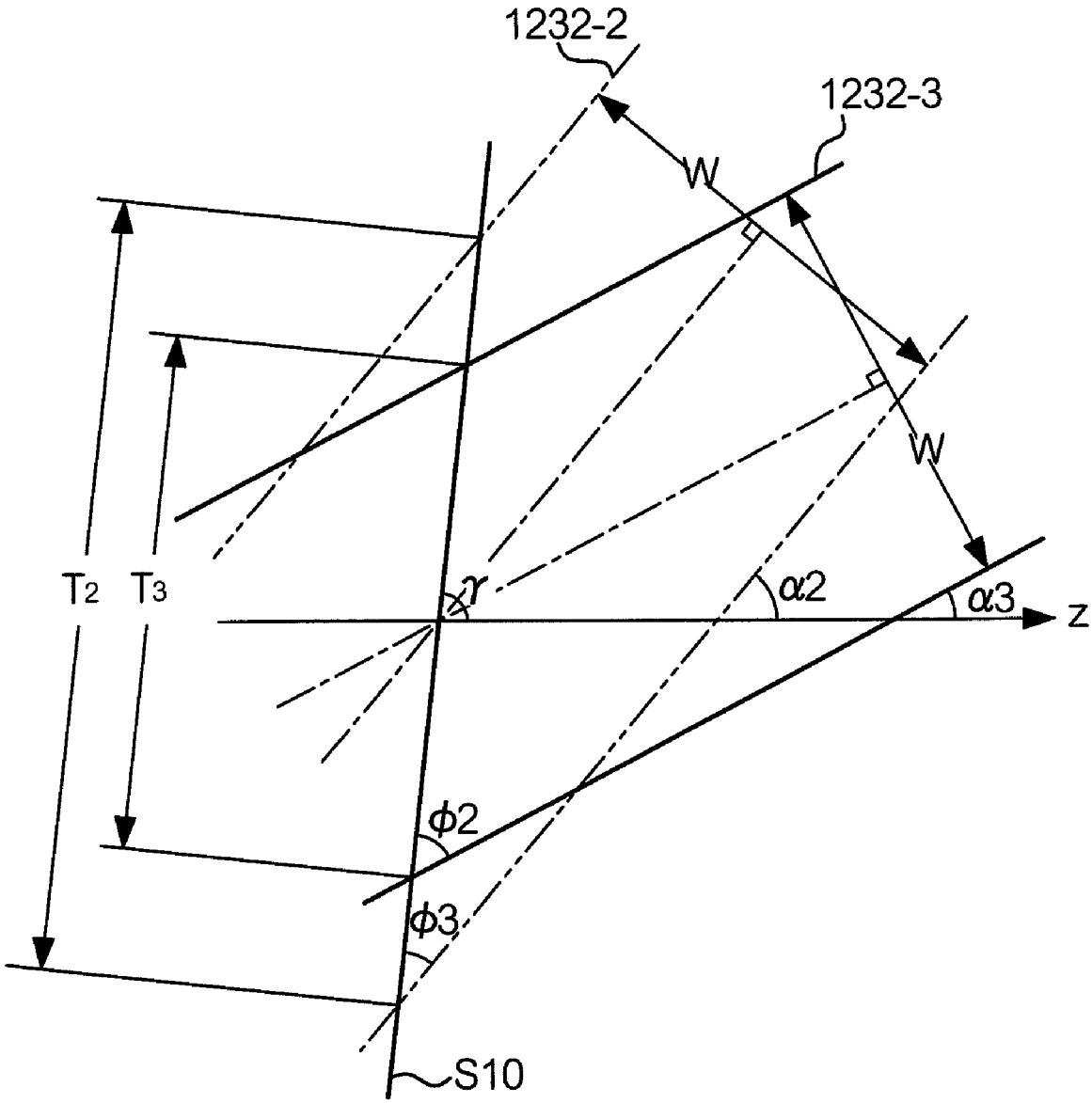
FIG. 22 is to explain influence of an angle between each second portion and an axial direction of a rotation shaft.

The angle between each second portion 1232 and an axial direction of the rotation shaft 1021 will now be described in relation to how easily the solids V1L and V1R can be extended. FIG. 22 shows second portions 1232-2 and 1232-3 as two examples, and explains influence of the angle between each second portion 1232 and an axial direction of the rotation shaft 1021, with reference to the examples. An angle of the second portion 1232-2 to the axial direction of the rotation shaft 1021 is $\alpha 2$. An angle of the second portion 1232-3 to the axial direction of the rotation shaft 1021 is $\alpha 3$. Between the angles $\alpha 2$ and $\alpha 3$, there is given a relationship in angular size: $90° \geqq \gamma > \alpha 2 > \alpha 3 > 0$ In this case, an angle $\phi 2$ between the second portion 1232-2 and the plane S10, and an angle $\phi 3$ between the second portion 1232-3 and the plane S10 are expressed by the following expression.

$$\phi 2 = \gamma - \alpha 2,\ \phi 3 = \gamma - \alpha 3 \tag{4}$$

The second portions 1232-2 and 1232-3 have an equal thickness W. Further, as shown in FIG. 22, a contact length by which the second portion 1232-2 has contact with an outer edge of the plane S10 as a cutting plane of the solid V1 is T2. Another contact length by which the second portion 1232-3 has contact with the outer edge is T3. The lengths T3 and T3 are expressed as follows by using the thickness W and angles $\phi 2$ and $\phi 3$.

$$T2 = W/\sin \phi 2,\ T3 = W/\sin \phi 3 \tag{5}$$

From the above relationship in angular size between $\gamma$, $\alpha 2$, and $\alpha 3$, $\alpha 2$ and $\alpha 3$ satisfies $90° > \alpha 2 > \alpha 3 > 0$. Hence, $\sin \phi 3 > \sin \phi 2$ is obtained. Accordingly, a relationship in length size between T2 and T3 is T2>T3. Thus, as the angle between the second portion 1232 and the axial direction of the rotation shaft 1021 decreases, the contact length by which the second portion 1232 has contact with an outer edge of a metal mold (solid V1) shortens. The longer the contact length, the longer the distance by which the metal mold needs to be moved when pulling out the metal mold from around the second portion 1232. That is, as the contact length increases, the metal mold is extended with more difficulty. In other words, the metal mold can be extended more easily as the contact length decreases. The metal mold can be extended more easily by setting a lower angle as the angle between each second portion 1232 and the axial direction of the rotation shaft 1021. In particular, the spiral member 1023 is usually made of resins and therefore has plasticity to some extent. Accordingly, the metal mold can be extended somewhat easily by further shortening the part where the spiral member 1023 has contact with an outer edge of a cutting plane of the metal mold at each of such lower angle portions (e.g., second portions 1232). Then, if only the spiral member 1023 having plasticity is deformed or warped adequately, the metal mold can satisfactorily be extended.

In the second embodiment described previously, the second portions 1232 provided in the spiral member 1023 linearly extend in directions parallel to each other when viewed in a direction parallel to an axial direction of the rotation shaft 1021. However, if the plane S10 dividing the solid V1 as a metal mold which holds the spiral member 1023 from inside need not extend through the diagonal line P13-P22 of each second portion 1232, the second portions 1232 need not be shaped so as to extend linearly in directions substantially parallel to each other when viewed in a direction parallel to an axial direction of the rotation shaft 1021. That is, even if each second portion 1232 is arc-shaped like the first portions 1231 when viewed in a direction parallel to an axial direction of the rotation shaft 1021, it suffices that the angle of each second portion 1232 to an axial direction of the rotation shaft 1021 is lower than the angle of each first portion 1231 to the axial direction of the rotation shaft 1021.

D. Modifications

The above embodiments may be modified as follows. Two or more of the embodiments described above and modifications described below may be combined with each other for use.

D-1. A method for connecting the rotation shaft 21 to the spiral member 23 is not limited to the method as described in the first embodiment. In the first embodiment, the rotation shaft 21 and the spiral member 23 are connected by the stir plates 24 at the high-angle portions 231. However, according to a modification, the rotation shaft 21 and the spiral member 23 may be connected at the low-angle portions 232. FIG. 6 is a cross-sectional view of a main part in the modification. As shown in FIG. 6, when the spiral member 23 rotates in the direction shown by the arrow D, the spiral member 23 receives an upward reaction force Fu in a lower right area in the figure due to an inertial force of the developer. At the same time, the spiral member 23 receives a downward reaction force Fd in a lower left area in the figure. FIG. 7 shows the spiral member 23 when a low-angle portions 232 is positioned at the bottom of the container chamber. At this time, in the lower right area in the figure, a boundary part E1 between the low-angle portion 232 and a high-angle portion 231 receives an upward reaction force Fu from the developer. In the lower left area in the figure, a boundary part E2 between the low-angle portion 232 and another high-angle portion 231 receives a downward reaction force Fu from the developer. Thus, the low-angle portions 232 sometimes simultaneously receive the reaction forces which act in different directions and thereby cause deformation or cracking with high possibility.

In this embodiment, the low-angle portions 232 are connected to the rotation shaft 21 by connection plates 25 as an example of second connection parts. When viewed in a direction parallel to an axial direction of the rotation shaft 21, the connection plates 25 and the stir plates 24 cross each other at 90 degrees. This structure is capable of bearing reaction forces acting in different directions or a shearing force generated between the low-angle portions 232 and the inner wall of the container chamber even if such reaction forces or a shearing force acts on the low-angle portions 232. This is because the low-angle portions 232 are firmly connected to the rotation shaft 21 by the connection plates 25 as described above. That is, the low-angle portions 232 supported by the connection plates 25 improve strength of the spiral member 23 and prevent deformation and/or cracking. As a result, the spiral member 23 can easily loosen a compacted developer. Instead of providing the stir plates 24, only the connection plates 25 may be provided as members which connect the rotation shaft 21 to the spiral member 23.

D-2. The position where each low-angle portion 232 is provided in the spiral member 23 is not limited to the position as described in the first embodiment. In the first embodiment, an angle of 180 degrees measures between two adjacent stir places 24A and 24B which are adjacent to each other in an axial direction of the rotation shaft 21, when viewed in a direction parallel to the axial direction. One low-angle portion 232 is provided for each one segment sandwiched between top ends of each two adjacent stir places 24A and 24B. That is, an angle of 180 degrees is held between perpendicular lines extended to the rotation shaft 21 from each two adjacent low-angle portions 232 which are adjacent to each other in an axial direction of the rotation shaft 21. However, the low-angle portions 232 may alternatively be provided so that the perpendicular lines extend at 120 degrees relative to each other. In this structure, a rate of the number of low-angle portions 232 provided per unit length of the spiral member 23 increases. As the rate increases, load applied from a compacted developer in the initial drive state is dispersively distributed so that strength of the conveyance member 20 improves. In addition, the amount of developer to be filled can be reduced to half or less of the total volume of the container chamber of the toner cartridge 10.

In the above embodiments, each of the low-angle portions 232 is positioned at an angle of 90 degrees to both the stir plates 24A and 24B about an axial direction of the rotation shaft 21, when viewed in a direction parallel to the axial direction of the rotation shaft 21. However, this angle is not limited to 90 degrees. In brief, the stir plates 24 each need only to be connected to any position on a high-angle portion 231 sandwiched between two adjacent low-angle portions 232.

D-3. The number of types of portions constituting the spiral member 23 is not limited to that described in the first embodiment. In the first embodiment, the spiral member 23 is constituted of two types of portions, i.e., the high-angle portions 231 and the low-angle portions 232. However, the spiral member 23 may include a third type of portions whose angle to the axial direction of the rotation shaft 21 differs from those of the high-angle portions 231 and low-angle portions 232. At connecting areas where such different types of portions are connected to each other, ridges are naturally formed as boundaries between the connected different types of portions. However, such different types of portions may be connected in smooth continuation with each other. In brief, the spiral member 23 needs only to include different types of portions, angles of which to the axial direction of the rotation shaft 21 differ respectively depending on the types of the portions.

Figure 23:
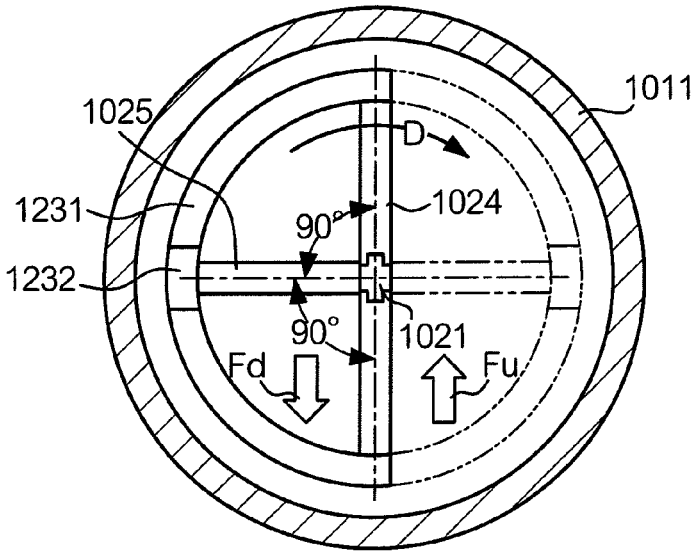
FIG. 23 is a side view of a main part of a modification.
Figure 24:
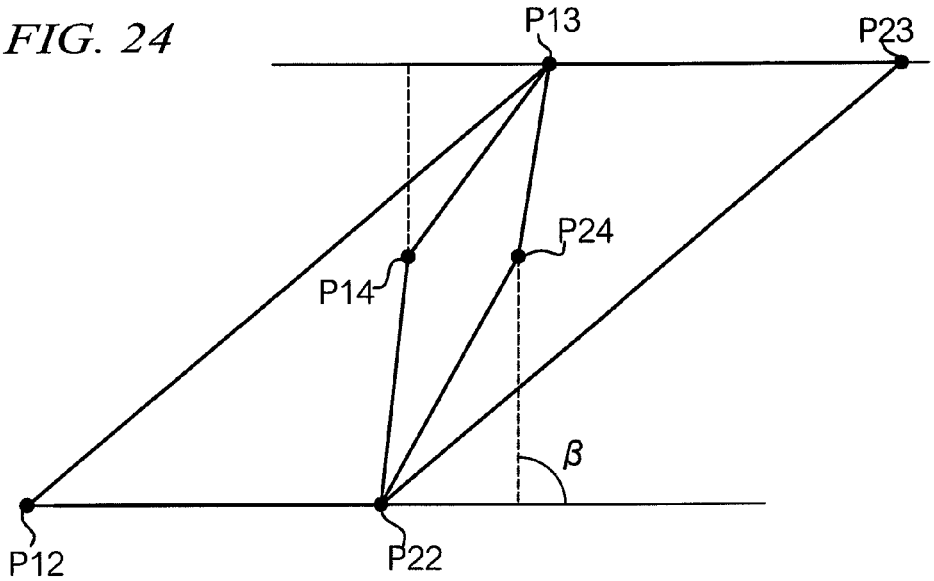
FIG. 24 is a side view for explaining second portions in a modification.

D-4. The positions at which the rotation shaft 1021 is connected to the spiral member 1023 are not limited to the first portions 1231. In the second and third embodiments, the rotation shaft 1021 and the spiral member 1023 are connected to each other at the first portions 1231 by the support plates 1024. However, according to a modification, the rotation shaft 1021 and the spiral member 1023 are connected to each other at the second portions 1232. FIG. 23 is a cross-sectional view of a main part of the modification. FIG. 24 is a side view which depicts the second portions 1232 according to the modification. As shown in FIGS. 23 and 24, the second portions 1232 are connected to the rotation shaft 1021 through the connection plates 1025. When viewed in a direction parallel to an axial direction of the rotation shaft 1021, an angle of 90 degrees is held between the connection plates 1025 and the support plates 1024. Each of the second portions 1232 has contact with a solid V1 (as a metal mold) in a plane having vertices of points P13, P14, P22, and P24. Points P14 and P24 are contained in the plane. Each of the connection plates 1025 contacts a second portion 1232 in a plane having vertices of P13, P14, P22, and P24. These points are arranged so that the point P14 has a greater y-component than the point P22 and the point P24 has a greater y-component than the point P13. In a case described previously, the solid V1 is divided by a plane containing the points P13 and P22. In this case, the connection plates 1025 need to be molded. Therefore, a part of the solid V1 which has contact with a second portion 1232 is divided by a plane which contains the points P22 and P14 and is parallel to the x-axis, and by a plane which contains the points P14 and P13 and is parallel to the x-axis. In addition, the solid V1 is also divided by a plane which contains the points P22 and P24 and is parallel to the x-axis, and by a plane which contains the points P24 and P13 and is parallel to the x-axis. In this manner, the connection plates 25 are formed, and the solid V1 is divided into partial solids each of which can be extended in the positive or negative y-axial direction, without biting each other. Further, the second portions 1232 are firmly supported on the rotation shaft 1021 through the connection plates 1025. Accordingly, the spiral member 1023 has improved strength, and deformation and cracking can be prevented. Instead of providing the support plates 1024, only the connection plates 1025 may be provided as members which connect the rotation shaft 1021 to the spiral member 1023.

D-5. The number of types of portions constituting the spiral member 1023 is not limited to that described in the second and third embodiments. In the second and third embodiments, the spiral member 1023 is constituted of two types of portions, i.e., the first portions 1231 and the second portions 1232. However, the spiral member 1023 may include a third type of portions whose angle to the axial direction of the rotation shaft 1021 differ from those of the first portions 1231 and second portions 1232. At connecting areas where such different types of portions are connected to each other, ridges are naturally formed as boundaries between the connected different types of portions. However, such different types of portions may be connected so as to continue smoothly to each other. In brief, the spiral member 1023 needs only to include different types of portions, angles of which to the axial direction of the rotation shaft 1021 differ respectively depending on the types of the portions.

What is claimed is:

1. A developer container comprising: a container chamber that has a container space for containing a developer; and a conveyance member having a rotation shaft and a spiral member which rotates inside the container space about the rotation shaft as a rotation center, the spiral member including a plurality of high-angle portions and a plurality of low-angle portions, the spiral member being spirally extended to an axial direction of the rotation shaft, angles of spirally extending directions of each of the plurality of high-angle portions to the axial direction being a first angle, angles of spirally extending directions of the plurality of low-angle portions to the axial direction being a second angle, which is smaller than the first angle, wherein at least one of the low-angle portions is provided in each unit segment which is equivalent to one turn of the spiral member about the rotation shaft, and an amount of a developer contained in the container space is enough to constantly bury one of the plurality of low-angle portions in the developer under a condition that the axial direction of the rotation shaft is held to be horizontal inside the container space, wherein the conveyance member further has a plurality of first connection parts, each of which connects the rotation shaft to the spiral member, and each one of the plurality of first connection parts is provided between adjacent two of the plurality of low-angle portions, with an exception that a first connection part is provided at each end of the rotation shaft, wherein, when viewed in a direction parallel to the axial direction of the rotation shaft, an angle of approximately 90 degrees is held between directions of the first connection parts extended to the spiral member and perpendicular lines extended from centers of the plurality of low-angle portions to the rotation shaft.

2. The developer container according to claim 1, wherein the amount of the developer contained in the container space is not enough to bury whole of the conveyance member in the developer.

3. A developer container comprising:

a container chamber that has a container space for containing a developer;

a conveyance member having a rotation shaft and a spiral member which rotates inside the container space about the rotation shaft as a rotation center, the spiral member including a plurality of high-angle portions and a plurality of low-angle portions, the spiral member being spirally extended to an axial direction of the rotation shaft, angles of spirally extending directions of each of the plurality of high-angle portions to the axial direction being a first angle, angles of spirally extending directions of the plurality of low-angle portions to the axial direction being a second angle, which is smaller than the first angle; and a plurality of second connection parts respectively connecting the plurality of low-angle portions to the rotation shaft, wherein at least one of the low-angle portions is provided in each unit segment which is equivalent to one turn of the spiral member about the rotation shaft, and an amount of a developer contained in the container space is enough to constantly bury one of the plurality of low-angle portions in the developer under a condition that the axial direction of the rotation shaft is held to be horizontal inside the container space.

4. The developer container according to claim 3, wherein the amount of the developer contained in the container space is not enough to bury whole of the conveyance member in the developer.

5. A developer container comprising:

a container chamber that has a container space for containing a developer; and a conveyance member having a rotation shaft and a spiral member which rotates inside the container space about the rotation shaft as a rotation center, the spiral member including a plurality of high-angle portions and a plurality of low-angle portions, the spiral member being spirally extended to an axial direction of the rotation shaft, angles of spirally extending directions of each of the plurality of high-angle portions to the axial direction being a first angle, angles of spirally extending directions of the plurality of low-angle portions to the axial direction being a second angle, which is smaller than the first angle, wherein at least one of the low-angle portions is provided in each unit segment which is equivalent to one turn of the spiral member about the rotation shaft, and an amount of a developer contained in the container space is enough to constantly bury one of the plurality of low-angle portions in the developer under a condition that the axial direction of the rotation shaft is held to be horizontal inside the container space, wherein:

the container space has a cylindrical shape, when the conveyance member is contained in the container space, an outer circumference of the spiral member is arranged to fit within an inner circumference of the container space, an angle of approximately 180 degrees is held between perpendicular lines extended to the rotation shaft respectively from centers of adjacent two of the plurality of low-angle portions, and an amount of the developer contained in the container space is enough to occupy half or more of a total volume of the container space.

6. The developer container according to claim 5, wherein the amount of the developer contained in the container space is enough to constantly bury both of the adjacent two of the plurality of low-angle portions in the developer.

7. The developer container according to claim 5, wherein the amount of the developer contained in the container space is not enough to bury whole of the conveyance member in the developer.

* * * * *